US012085374B2

(12) United States Patent
Padgett et al.

(10) Patent No.: US 12,085,374 B2
(45) Date of Patent: Sep. 10, 2024

(54) INTERLOCKING STACKING AMMUNITION CONTAINERS

(71) Applicant: PCP AMMUNITION COMPANY, LLC, Vero Beach, FL (US)

(72) Inventors: Charles Padgett, Vero Beach, FL (US); Robert Lanse Padgett, Vero Beach, FL (US)

(73) Assignee: PCP Ammunition Company, LLC, Sebastian, FL (US)

( * ) Notice: Subject to any disclaimer, the term of this patent is extended or adjusted under 35 U.S.C. 154(b) by 175 days.

(21) Appl. No.: 17/424,125

(22) PCT Filed: Jan. 17, 2020

(86) PCT No.: PCT/US2020/014100
§ 371 (c)(1),
(2) Date: Jul. 19, 2021

(87) PCT Pub. No.: WO2020/150612
PCT Pub. Date: Jul. 23, 2020

(65) Prior Publication Data

US 2022/0099420 A1 Mar. 31, 2022

Related U.S. Application Data

(60) Provisional application No. 62/794,331, filed on Jan. 18, 2019.

(51) Int. Cl.
*F42B 39/26* (2006.01)
*B65D 21/02* (2006.01)
*B65D 19/44* (2006.01)

(52) U.S. Cl.
CPC ..... *F42B 39/26* (2013.01); *B65D 21/0223* (2013.01)

(58) Field of Classification Search
CPC ..... B65D 21/0223; B65D 2543/00027; B65D 2519/00965; B65D 2519/00955;
(Continued)

(56) References Cited

U.S. PATENT DOCUMENTS 3,974,739 A 8/1976 Bourlet
4,392,407 A * 7/1983 LaFever ..... F41A 9/79 89/33.14

(Continued)

FOREIGN PATENT DOCUMENTS

KR 101438690 B1 * 9/2014 ..... B65D 19/0036

OTHER PUBLICATIONS

Extended European Search Report dated Sep. 5, 2022, from corresponding European Application No. 20741793.2.

(Continued)

*Primary Examiner* — Anthony D Stashick
*Assistant Examiner* — Marcos Javier Rodriguez Molina
(74) *Attorney, Agent, or Firm* — Troutman Pepper Hamilton Sanders LLP

(57) ABSTRACT

An ammunition container can include a bottom wall, a first side wall and an opposing second side wall, and a front wall and an opposing rear wall. An interior volume can be formed from the five walls. A top lid can be removably engaged to one of the first side wall, the second side wall, the front wall, and the rear wall, opposite the bottom wall. The lid encloses the interior volume. A first interlocking stacking element can have a first raised protrusion forming a first shape and disposed on the top lid or the bottom wall. A second interlocking stacking element of second raised protrusions forming a second shape on the opposite wall. It can be sized or shaped to interlock with the first interlocking stacking (Continued)

element. The first and second interlocking elements can prevent movement along at least one axis or two axes (i.e. sliding or disengagement).

11 Claims, 9 Drawing Sheets

(58) Field of Classification Search
CPC ..... B65D 2519/00935; B65D 2519/00815; B65D 2519/00338; B65D 2519/00069; B65D 2519/00034; B65D 2501/24681; B65D 2501/24598; B65D 2501/24592; B65D 2501/2456; B65D 2501/24554; B65D 21/06; B65D 21/048; B65D 21/043; B65D 21/0235; B65D 21/0234; B65D 21/0226; B65D 21/0224; B65D 21/0217; B65D 21/0216; B65D 21/0215; B65D 21/0213; B65D 21/0212; B65D 21/0209; B65D 21/0201; B65D 21/02; B65D 21/00; B65D 19/385; B65D 19/38; B65D 19/0053; B65D 19/00; B65D 1/00; B65D 1/02; B65D 1/0207; B65D 1/0215; B65D 1/0223; B65D 1/023; B65D 1/0238; B65D 1/0246; B65D 1/0276; B65D 1/0284; B65D 1/0292; B65D 1/095; B65D 1/12; B65D 1/14; B65D 1/16; B65D 1/165; B65D 1/18; B65D 1/20; B65D 1/22; B65D 1/225; B65D 1/24; B65D 1/243; B65D 1/246; B65D 1/26; B65D 1/265; B65D 1/32; B65D 1/34; B65D 1/36; B65D 1/38; B65D 1/40; B65D 1/42; B65D 1/44; B65D 1/46; B65D 11/00; B65D 11/02; B65D 11/06; B65D 11/10; B65D 11/14; B65D 11/16; B65D 11/18; B65D 11/1826; B65D 11/1833; B65D 11/184; B65D 11/1846; B65D 11/1853; B65D 11/1866; B65D 11/1873; B65D 11/188; B65D 11/1893; B65D 11/22; B65D 11/24; B65D 11/26; B65D 11/28; B65D 13/00; B65D 15/06; B65D 15/08; B65D 15/14; B65D 15/22; B65D 15/24; B65D 17/00; B65D 17/02; B65D 17/28; B65D 17/401; B65D 17/4011; B65D 17/4012; B65D 17/4014; B65D 17/402; B65D 17/464; B65D 17/50; B65D 17/502; B65D 19/0002; B65D 19/0004; B65D 19/0012; B65D 19/0014; B65D 19/0018; B65D 19/002; B65D 19/0026; B65D 19/0028; B65D 19/0032; B65D 19/0034; B65D 19/0036; B65D 19/0038; B65D 19/004; B65D 19/0042; B65D 19/0048; B65D 19/0063; B65D 19/0069; B65D 19/0073; B65D 19/0095; B65D 19/0097; B65D 19/02; B65D 19/06; B65D 19/08; B65D 19/10; B65D 19/12; B65D 19/16; B65D 19/18; B65D 19/40; B65D 19/42; B65D 19/44; B65D 21/0202; B65D 21/0204; B65D 21/0205; B65D 21/0219; B65D 21/022; B65D 21/0222; B65D 21/0228; B65D 21/023; B65D 21/0231; B65D 21/04; B65D 21/041; B65D 21/045; B65D 21/046; B65D 21/062; B65D 21/064; B65D 21/066; B65D 21/068; B65D 21/08; B65D 21/083; B65D 21/086; B65D 2201/00; B65D 2203/00; B65D 2203/02; B65D 2203/04; B65D 2203/10; B65D 2203/12; B65D 2205/00; B65D 2205/02; B65D 2207/00; B65D 2211/00; B65D 2213/00; B65D 2213/02; B65D 2215/04; B65D 2231/002; B65D 2231/02; B65D 2231/022; B65D 2251/0015; B65D 2251/0018; B65D 2251/0021; B65D 2251/0025; B65D 2251/0028; B65D 2251/0062; B65D 2251/0071; B65D 2251/00872; B65D 2251/009; B65D 2251/0093; B65D 2251/01; B65D 2251/1008; B65D 2251/1016; B65D 2251/1025; B65D 2251/1041; B65D 2251/105; B65D 2251/1058; B65D 2251/1083; B65D 2251/1091; B65D 2251/20; B65D 2251/205; B65D 23/00; B65D 23/001; B65D 23/02; B65D 23/0807; B65D 23/0814; B65D 23/0821; B65D 23/0864; B65D 23/0885; B65D 23/10; B65D 23/102; B65D 23/104; B65D 23/108; B65D 23/12; B65D 2301/10; B65D 2301/20; B65D 2313/00; B65D 2313/02; B65D 2313/04; B65D 2401/00; B65D 2401/05; B65D 2401/10; B65D 2401/15; B65D 2401/25; B65D 2401/35; B65D 2401/60; B65D 25/00; B65D 25/005; B65D 25/02; B65D 25/04; B65D 25/06; B65D 25/08; B65D 25/10; B65D 25/101; B65D 25/102; B65D 25/103; B65D 25/107; B65D 25/108; B65D 25/14; B65D 25/16; B65D 25/18; B65D 25/20; B65D 25/205; B65D 25/22; B65D 25/24; B65D 25/28; B65D 25/2802; B65D 25/2808; B65D 25/2811; B65D 25/282; B65D 25/2826; B65D 25/2835; B65D 25/2841; B65D 25/2858; B65D 25/2867; B65D 25/2876; B65D 25/2885; B65D 25/2888; B65D 25/2894; B65D 25/2897; B65D 25/30; B65D 25/32; B65D 25/325; B65D 25/34; B65D 25/36; B65D 25/38; B65D 25/385; B65D 25/42; B65D 25/48; B65D 25/52; B65D 25/525; B65D 25/54; B65D 25/56; B65D 2501/00; B65D 2501/0027; B65D 2501/0036; B65D 2501/0081; B65D 2501/24019; B65D 2501/24057; B65D 2501/2407; B65D 2501/24082; B65D 2501/24095; B65D 2501/24108; B65D 2501/24114; B65D 2501/24127; B65D 2501/24133; B65D 2501/24152; B65D 2501/24184; B65D 2501/2421; B65D 2501/24216; B65D 2501/24235; B65D 2501/24254; B65D 2501/24261; B65D 2501/24267; B65D 2501/24324; B65D 2501/2435; B65D 2501/24356; B65D 2501/24375; B65D 2501/24426; B65D 2501/24484; B65D 2501/24522; B65D 2501/24541; B65D 2501/24547; B65D 2501/24566; B65D 2501/24605; B65D 2501/24656; B65D 2501/24694; B65D 2501/24777; B65D 2501/24783; B65D 2501/24796; B65D 2501/24808; B65D 2501/24834; B65D 2501/24847; B65D 2501/24961; B65D 2501/24987; B65D 2517/0004; B65D
2517/0013; B65D 2517/0014; B65D
2517/0016; B65D 2517/0046; B65D
2517/0049; B65D 2517/0062; B65D
2517/0073; B65D 2517/0079; B65D
2517/0098; B65D 2517/5059; B65D
2517/5083; B65D 2519/00019; B65D
2519/00024; B65D 2519/00029; B65D
2519/00039; B65D 2519/00044; B65D
2519/00054; B65D 2519/00059; B65D
2519/00064; B65D 2519/00074; B65D
2519/00079; B65D 2519/00089; B65D
2519/00094; B65D 2519/00099; B65D
2519/00104; B65D 2519/00124; B65D
2519/00129; B65D 2519/00134; B65D
2519/00139; B65D 2519/00159; B65D
2519/00164; B65D 2519/00169; B65D
2519/00174; B65D 2519/00179; B65D
2519/00184; B65D 2519/00199; B65D
2519/00208; B65D 2519/00213; B65D
2519/00218; B65D 2519/00233; B65D
2519/00243; B65D 2519/00268; B65D
2519/00273; B65D 2519/00278; B65D
2519/00288; B65D 2519/00293; B65D
2519/00298; B65D 2519/00303; B65D
2519/00308; B65D 2519/00318; B65D
2519/00323; B65D 2519/00333; B65D
2519/00343; B65D 2519/00348; B65D
2519/00353; B65D 2519/00363; B65D
2519/00373; B65D 2519/00378; B65D
2519/00383; B65D 2519/00398; B65D
2519/00402; B65D 2519/00407; B65D
2519/00412; B65D 2519/00417; B65D
2519/00422; B65D 2519/00427; B65D
2519/00437; B65D 2519/00442; B65D
2519/00447; B65D 2519/00452; B65D
2519/00467; B65D 2519/00472; B65D
2519/00497; B65D 2519/00502; B65D
2519/00507; B65D 2519/00512; B65D
2519/00522; B65D 2519/00527; B65D
2519/00532; B65D 2519/00557; B65D
2519/00562; B65D 2519/00567; B65D
2519/00572; B65D 2519/00582; B65D
2519/00587; B65D 2519/00592; B65D
2519/00597; B65D 2519/00601; B65D
2519/00611; B65D 2519/00616; B65D
2519/00621; B65D 2519/00631; B65D
2519/00636; B65D 2519/00641; B65D
2519/00646; B65D 2519/00656; B65D
2519/00661; B65D 2519/00666; B65D
2519/00676; B65D 2519/00681; B65D
2519/00691; B65D 2519/00696; B65D
2519/00701; B65D 2519/00711; B65D
2519/00716; B65D 2519/00771; B65D
2519/00781; B65D 2519/00786; B65D
2519/00791; B65D 2519/00796; B65D
2519/008; B65D 2519/00805; B65D
2519/0081; B65D 2519/0082; B65D
2519/00825; B65D 2519/00835; B65D
2519/0084; B65D 2519/0086; B65D
2519/00865; B65D 2519/0087; B65D
2519/00875; B65D 2519/0088; B65D
2519/009; B65D 2519/0091; B65D
2519/00915; B65D 2519/00925; B65D
2519/0041; B65D 2519/0096; B65D
2519/0097; B65D 2519/00975; B65D
2519/0098; B65D 2519/00985; B65D
2519/0099; B65D 2519/00995; B65D
2525/281; B65D 2525/286; B65D
2525/288; B65D 2525/289; B65D
2539/003; B65D 2543/00018; B65D
2543/00046; B65D 2543/00083; B65D
2543/00092; B65D 2543/00101; B65D
2543/00138; B65D 2543/00148; B65D
2543/00175; B65D 2543/00194; B65D
2543/00203; B65D 2543/00222; B65D
2543/00231; B65D 2543/0024; B65D
2543/0025; B65D 2543/00259; B65D
2543/00268; B65D 2543/00277; B65D
2543/00296; B65D 2543/00305; B65D
2543/00314; B65D 2543/00351; B65D
2543/00361; B65D 2543/0037; B65D
2543/00379; B65D 2543/00388; B65D
2543/00398; B65D 2543/00407; B65D
2543/00416; B65D 2543/00425; B65D
2543/00435; B65D 2543/00462; B65D
2543/005; B65D 2543/00509; B65D
2543/00518; B65D 2543/00527; B65D
2543/00537; B65D 2543/00546; B65D
2543/00555; B65D 2543/00564; B65D
2543/00574; B65D 2543/00583; B65D
2543/00611; B65D 2543/0062; B65D
2543/00629; B65D 2543/00638; B65D
2543/00648; B65D 2543/00657; B65D
2543/00675; B65D 2543/00685; B65D
2543/00694; B65D 2543/00703; B65D
2543/00731; B65D 2543/0074; B65D
2543/00759; B65D 2543/00768; B65D
2543/00787; B65D 2543/00796; B65D
2543/00805; B65D 2543/00814; B65D
2543/00842; B65D 2543/00851; B65D
2543/0087; B65D 2543/00879; B65D
2543/00888; B65D 2543/00925; B65D
2543/00944; B65D 2543/00953; B65D
2543/00972; B65D 2543/00981; B65D
2543/0099; B65D 2565/385; B65D
2571/00043; B65D 2571/00055; B65D
2571/00061; B65D 2571/00074; B65D
2571/00086; B65D 2571/00092; B65D
2571/00098; B65D 2571/00111; B65D
2571/00117; B65D 2571/00141; B65D
2571/00493; B65D 2571/00567; B65D
2571/0066; B65D 2571/00679; B65D
2571/00895; B65D 2571/00901; B65D
2571/00981; B65D 2571/00987; B65D
2575/3245; B65D 2575/3254; B65D
2575/583; B65D 2575/586; B65D
2577/042; B65D 2577/043; B65D
2577/047; B65D 2577/048; B65D
2577/2091; B65D 2581/02; B65D
2581/055; B65D 2581/058; B65D
2581/3494; B65D 2583/00; B65D
2583/005; B65D 2583/087; B65D
2585/00; B65D 2585/366; B65D
2585/6835; B65D 2585/6837; B65D
2585/686; B65D 2585/6867; B65D
2585/687; B65D 2585/6875; B65D
2585/6882; B65D 2585/689; B65D
2585/6897; B65D 2585/86; B65D
2585/88; B65D 2588/02; B65D 2588/12;

B65D 2588/74; B65D 2590/0033; B65D 2590/0066; B65D 2590/0083; B65D 2590/0091; B65D 2590/026; B65D 2590/046; B65D 2590/245; B65D 2590/666; B65D 29/00; B65D 3/00; B65D 3/04; B65D 3/06; B65D 3/12; B65D 3/14; B65D 3/20; B65D 3/22; B65D 3/26; B65D 3/262; B65D 3/263; B65D 3/264; B65D 3/265; B65D 3/28; B65D 3/30; B65D 31/10; B65D 33/00; B65D 33/001; B65D 33/005; B65D 33/01; B65D 33/06; B65D 33/08; B65D 33/12; B65D 33/14; B65D 33/16; B65D 33/1658; B65D 33/2508; B65D 33/2541; B65D 33/30; B65D 35/10; B65D 35/12; B65D 35/14; B65D 35/22; B65D 35/242; B65D 37/00; B65D 39/00; B65D 39/0011; B65D 39/0017; B65D 39/0029; B65D 39/088; B65D 39/12; B65D 41/00; B65D 41/005; B65D 41/02; B65D 41/04; B65D 41/0414; B65D 41/0421; B65D 41/0428; B65D 41/0442; B65D 41/045; B65D 41/0471; B65D 41/0492; B65D 41/08; B65D 41/16; B65D 41/185; B65D 41/32; B65D 41/34; B65D 41/3404; B65D 41/3409; B65D 41/3428; B65D 41/3442; B65D 41/3447; B65D 41/46; B65D 41/48; B65D 41/58; B65D 43/02; B65D 43/0202; B65D 43/0204; B65D 43/0208; B65D 43/021; B65D 43/0212; B65D 43/0214; B65D 43/0216; B65D 43/0218; B65D 43/022; B65D 43/0225; B65D 43/0229; B65D 43/0231; B65D 43/0235; B65D 43/0249; B65D 43/0252; B65D 43/026; B65D 43/0268; B65D 43/06; B65D 43/065; B65D 43/08; B65D 43/12; B65D 43/14; B65D 43/16; B65D 43/161; B65D 43/162; B65D 43/163; B65D 43/164; B65D 43/165; B65D 43/166; B65D 43/167; B65D 43/168; B65D 43/169; B65D 43/20; B65D 43/22; B65D 43/26; B65D 43/262; B65D 45/00; B65D 45/02; B65D 45/16; B65D 45/18; B65D 45/20; B65D 45/22; B65D 45/28; B65D 45/32; B65D 45/322; B65D 45/327; B65D 47/00; B65D 47/04; B65D 47/043; B65D 47/06; B65D 47/063; B65D 47/0804; B65D 47/0828; B65D 47/0847; B65D 47/0852; B65D 47/088; B65D 47/089; B65D 47/121; B65D 47/141; B65D 47/143; B65D 47/147; B65D 47/148; B65D 47/18; B65D 47/205; B65D 47/2075; B65D 47/2093; B65D 47/241; B65D 47/247; B65D 47/265; B65D 47/283; B65D 47/286; B65D 47/30; B65D 47/32; B65D 47/36; B65D 47/42; B65D 49/04; B65D 49/12; B65D 5/00; B65D 5/001; B65D 5/0015; B65D 5/002; B65D 5/0025; B65D 5/003; B65D 5/0035; B65D 5/0045; B65D 5/005; B65D 5/0055; B65D 5/006; B65D 5/0065; B65D 5/007; B65D 5/0075; B65D 5/02; B65D 5/0218; B65D 5/0227; B65D 5/0281; B65D 5/029; B65D 5/06; B65D 5/064; B65D 5/067; B65D 5/068; B65D 5/103; B65D 5/106; B65D 5/18; B65D 5/20; B65D 5/2009; B65D 5/2033; B65D 5/2047; B65D 5/2076; B65D 5/2085; B65D 5/22; B65D 5/24; B65D 5/241; B65D 5/247; B65D 5/248; B65D 5/26; B65D 5/28; B65D 5/30; B65D 5/302; B65D 5/32; B65D 5/321; B65D 5/323; B65D 5/36; B65D 5/3621; B65D 5/3628; B65D 5/365; B65D 5/3671; B65D 5/42; B65D 5/4204; B65D 5/4216; B65D 5/4266; B65D 5/4279; B65D 5/4283; B65D 5/4295; B65D 5/44; B65D 5/441; B65D 5/443; B65D 5/445; B65D 5/448; B65D 5/46; B65D 5/4608; B65D 5/4612; B65D 5/46192; B65D 5/48; B65D 5/48002; B65D 5/48024; B65D 5/48038; B65D 5/48044; B65D 5/50; B65D 5/5021; B65D 5/5035; B65D 5/5038; B65D 5/52; B65D 5/54; B65D 5/542; B65D 5/545; B65D 5/548; B65D 5/563; B65D 5/62; B65D 5/64; B65D 5/6644; B65D 5/6685; B65D 5/6691; B65D 5/6694; B65D 5/6697; B65D 5/68; B65D 5/685; B65D 5/726; B65D 5/745; B65D 5/746; B65D 5/748; B65D 5/76; B65D 50/02; B65D 50/04; B65D 50/041; B65D 50/046; B65D 51/00; B65D 51/002; B65D 51/14; B65D 51/145; B65D 51/16; B65D 51/1605; B65D 51/1611; B65D 51/1616; B65D 51/1633; B65D 51/1644; B65D 51/165; B65D 51/1661; B65D 51/18; B65D 51/20; B65D 51/22; B65D 51/221; B65D 51/222; B65D 51/225; B65D 51/228; B65D 51/24; B65D 51/242; B65D 51/245; B65D 51/246; B65D 51/247; B65D 51/248; B65D 51/26; B65D 51/28; B65D 51/2878; B65D 51/2892; B65D 51/30; B65D 53/00; B65D 53/02; B65D 55/02; B65D 55/024; B65D 55/026; B65D 55/04; B65D 55/06; B65D 55/0818; B65D 55/10; B65D 55/12; B65D 55/14; B65D 55/145; B65D 55/16; B65D 57/003; B65D 57/004; B65D 59/02; B65D 59/04; B65D 59/06; B65D 59/08; B65D 61/00; B65D 63/08; B65D 63/109; B65D 63/16; B65D 65/12; B65D 65/14; B65D 65/38; B65D 65/40; B65D 65/42; B65D 65/44; B65D 65/46; B65D 65/466; B65D 67/02; B65D 7/00; B65D 7/02; B65D 7/04; B65D 7/045; B65D 7/08; B65D 7/24; B65D 7/26; B65D 7/28; B65D 7/32; B65D 71/00; B65D 71/0003; B65D 71/0088; B65D 71/0092; B65D 71/0096; B65D 71/02; B65D 71/04; B65D 71/06; B65D 71/08; B65D 71/46; B65D 71/50; B65D 71/502; B65D 71/504; B65D 71/70; B65D 73/0035; B65D 73/0042; B65D 73/0057; B65D 73/02; B65D 75/002; B65D 75/00; B65D 75/08; B65D 75/14; B65D 75/22; B65D 75/24; B65D 75/245; B65D 75/26; B65D 75/305; B65D 75/32; B65D 75/323; B65D 75/324; B65D 75/326; B65D 75/327; B65D 75/36; B65D 75/366;

B65D 75/54; B65D 75/56; B65D 75/58; B65D 75/5822; B65D 75/5838; B65D 75/585; B65D 75/5877; B65D 75/5883; B65D 77/003; B65D 77/02; B65D 77/04; B65D 77/0413; B65D 77/0446; B65D 77/0453; B65D 77/046; B65D 77/0466; B65D 77/0486; B65D 77/0493; B65D 77/06; B65D 77/061; B65D 77/062; B65D 77/065; B65D 77/067; B65D 77/18; B65D 77/185; B65D 77/20; B65D 77/2024; B65D 77/2032; B65D 77/2088; B65D 77/22; B65D 77/225; B65D 77/24; B65D 77/245; B65D 77/26; B65D 77/283; B65D 77/40; B65D 79/005; B65D 79/008; B65D 79/0081; B65D 79/0084; B65D 79/0087; B65D 81/00; B65D 81/02; B65D 81/022; B65D 81/025; B65D 81/027; B65D 81/03; B65D 81/05; B65D 81/052; B65D 81/053; B65D 81/054; B65D 81/055; B65D 81/056; B65D 81/057; B65D 81/07; B65D 81/107; B65D 81/1075; B65D 81/113; B65D 81/127; B65D 81/1275; B65D 81/133; B65D 81/18; B65D 81/20; B65D 81/2007; B65D 81/2015; B65D 81/2023; B65D 81/2038; B65D 81/2053; B65D 81/2069; B65D 81/2076; B65D 81/2084; B65D 81/24; B65D 81/26; B65D 81/261; B65D 81/262; B65D 81/263; B65D 81/264; B65D 81/266; B65D 81/268; B65D 81/30; B65D 81/32; B65D 81/3205; B65D 81/3211; B65D 81/3216; B65D 81/325; B65D 81/3261; B65D 81/3266; B65D 81/3288; B65D 81/3294; B65D 81/34; B65D 81/343; B65D 81/3453; B65D 81/3461; B65D 81/36; B65D 81/361; B65D 81/365; B65D 81/38; B65D 81/3813; B65D 81/3816; B65D 81/3818; B65D 81/382; B65D 81/3823; B65D 81/3869; B65D 81/3874; B65D 81/3879; B65D 83/00; B65D 83/0005; B65D 83/0033; B65D 83/0038; B65D 83/005; B65D 83/0055; B65D 83/0072; B65D 83/0083; B65D 83/0094; B65D 83/02; B65D 83/04; B65D 83/0409; B65D 83/0418; B65D 83/0427; B65D 83/0472; B65D 83/0481; B65D 83/06; B65D 83/08; B65D 83/0805; B65D 83/0882; B65D 83/0894; B65D 83/10; B65D 83/14; B65D 83/16; B65D 83/20; B65D 83/201; B65D 83/205; B65D 83/206; B65D 83/22; B65D 83/226; B65D 83/24; B65D 83/28; B65D 83/30; B65D 83/303; B65D 83/32; B65D 83/38; B65D 83/384; B65D 83/40; B65D 83/42; B65D 83/44; B65D 83/46; B65D 83/48; B65D 83/54; B65D 83/565; B65D 83/62; B65D 83/64; B65D 83/66; B65D 83/75; B65D 83/752; B65D 83/756; B65D 85/00; B65D 85/02; B65D 85/04; B65D 85/06; B65D 85/07; B65D 85/1018; B65D 85/1056; B65D 85/10564; B65D 85/14; B65D 85/18; B65D 85/187; B65D 85/20; B65D 85/24; B65D 85/26; B65D 85/30; B65D 85/305; B65D 85/307; B65D 85/32; B65D 85/322; B65D 85/324; B65D 85/34; B65D 85/345; B65D 85/36; B65D 85/38; B65D 85/42; B65D 85/46; B65D 85/48; B65D 85/50; B65D 85/505; B65D 85/52; B65D 85/54; B65D 85/58; B65D 85/60; B65D 85/62; B65D 85/66; B65D 85/67; B65D 85/672; B65D 85/68; B65D 85/70; B65D 85/72; B65D 85/76; B65D 85/78; B65D 85/80; B65D 85/804; B65D 85/8043; B65D 85/8046; B65D 85/8061; B65D 85/812; B65D 85/816; B65D 85/84; B65D 88/00; B65D 88/005; B65D 88/02; B65D 88/022; B65D 88/04; B65D 88/10; B65D 88/12; B65D 88/121; B65D 88/123; B65D 88/126; B65D 88/129; B65D 88/14; B65D 88/16; B65D 88/1612; B65D 88/1643; B65D 88/1656; B65D 88/20; B65D 88/22; B65D 88/34; B65D 88/42; B65D 88/48; B65D 88/52; B65D 88/522; B65D 88/524; B65D 88/526; B65D 88/528; B65D 88/54; B65D 88/542; B65D 88/74; B65D 88/76; B65D 88/78; B65D 9/00; B65D 9/02; B65D 9/06; B65D 9/12; B65D 9/24; B65D 9/32; B65D 9/34; B65D 9/36; B65D 9/38; B65D 90/00; B65D 90/0006; B65D 90/0013; B65D 90/002; B65D 90/0026; B65D 90/0033; B65D 90/004; B65D 90/0053; B65D 90/006; B65D 90/0066; B65D 90/0073; B65D 90/008; B65D 90/02; B65D 90/021; B65D 90/022; B65D 90/028; B65D 90/029; B65D 90/046; B65D 90/048; B65D 90/06; B65D 90/08; B65D 90/10; B65D 90/12; B65D 90/14; B65D 90/20; B65D 90/205; B65D 90/22; B65D 90/24; B65D 90/32; B65D 90/325; B65D 90/34; B65D 90/36; B65D 90/40; B65D 90/44; B65D 90/48; B65D 90/503; B65D 90/52; B65D 90/54; B65D 90/623; B65D 90/626; B65D 90/64; B65D 90/66; F42B 39/26; F42B 1/00; F42B 1/02; F42B 1/024; F42B 1/028; F42B 1/032; F42B 1/036; F42B 10/02; F42B 10/04; F42B 10/06; F42B 10/08; F42B 10/14; F42B 10/16; F42B 10/18; F42B 10/22; F42B 10/26; F42B 10/32; F42B 10/34; F42B 10/36; F42B 10/38; F42B 10/42; F42B 10/44; F42B 10/46; F42B 10/48; F42B 10/50; F42B 10/56; F42B 12/00; F42B 12/02; F42B 12/06; F42B 12/10; F42B 12/105; F42B 12/14; F42B 12/20; F42B 12/204; F42B 12/205; F42B 12/207; F42B 12/208; F42B 12/22; F42B 12/24; F42B 12/32; F42B 12/34; F42B 12/36; F42B 12/362; F42B 12/365; F42B 12/367; F42B 12/38; F42B 12/382; F42B 12/40; F42B 12/42; F42B 12/44; F42B 12/46; F42B 12/48; F42B 12/50; F42B 12/52; F42B 12/54; F42B 12/56; F42B 12/58; F42B 12/60; F42B 12/62; F42B 12/625; F42B 12/64; F42B 12/66; F42B 12/68; F42B 12/70; F42B 12/72; F42B 12/74; F42B 12/745;

F42B 12/76; F42B 12/78; F42B 12/80; F42B 12/82; F42B 14/00; F42B 14/02; F42B 14/04; F42B 14/06; F42B 14/061; F42B 14/064; F42B 14/065; F42B 14/068; F42B 15/00; F42B 15/08; F42B 15/10; F42B 15/12; F42B 15/22; F42B 15/36; F42B 23/00; F42B 23/005; F42B 23/04; F42B 23/16; F42B 23/24; F42B 25/00; F42B 27/00; F42B 27/08; F42B 3/00; F42B 3/02; F42B 3/04; F42B 3/08; F42B 3/093; F42B 3/10; F42B 3/11; F42B 3/22; F42B 3/28; F42B 30/00; F42B 30/006; F42B 30/02; F42B 30/04; F42B 30/06; F42B 30/08; F42B 30/10; F42B 30/12; F42B 33/00; F42B 33/001; F42B 33/002; F42B 33/004; F42B 33/005; F42B 33/008; F42B 33/02; F42B 33/0207; F42B 33/0214; F42B 33/025; F42B 33/0285; F42B 33/0292; F42B 33/04; F42B 33/06; F42B 33/062; F42B 33/067; F42B 33/12; F42B 33/14; F42B 35/00; F42B 35/02; F42B 39/00; F42B 39/002; F42B 39/02; F42B 39/08; F42B 39/085; F42B 39/087; F42B 39/10; F42B 39/14; F42B 39/16; F42B 39/18; F42B 39/20; F42B 39/22; F42B 39/24; F42B 39/28; F42B 39/30; F42B 4/00; F42B 4/02; F42B 4/16; F42B 4/22; F42B 4/24; F42B 4/26; F42B 5/00; F42B 5/02; F42B 5/025; F42B 5/03; F42B 5/035; F42B 5/045; F42B 5/05; F42B 5/067; F42B 5/08; F42B 5/10; F42B 5/105; F42B 5/145; F42B 5/15; F42B 5/155; F42B 5/16; F42B 5/18; F42B 5/181; F42B 5/182; F42B 5/184; F42B 5/188; F42B 5/192; F42B 5/196; F42B 5/24; F42B 5/26; F42B 5/28; F42B 5/285; F42B 5/297; F42B 5/30; F42B 5/307; F42B 5/313; F42B 5/32; F42B 5/38; F42B 6/00; F42B 6/006; F42B 6/04; F42B 6/10; F42B 7/00; F42B 7/02; F42B 7/04; F42B 7/043; F42B 7/046; F42B 7/06; F42B 7/08; F42B 7/10; F42B 7/12; F42B 8/00; F42B 8/02; F42B 8/04; F42B 8/10; F42B 8/12; F42B 8/14; F42B 8/16; F42B 8/20; F42B 8/24; F42B 8/26; F42B 99/00

USPC ..... 206/3, 83.5, 821, 817, 814, 811, 804, 206/756, 736, 735, 730, 725, 711, 710, 206/703, 701, 69, 600, 599, 598, 597, 206/596, 595, 594, 593, 592, 591, 589, 206/588, 587, 586, 585, 583, 582, 565, 206/564, 561, 560, 559, 558, 557, 555, 206/544, 54, 527, 526, 524.8, 524.6, 206/524.5, 524.3, 524.2, 524.1, 523, 522, 206/521.8, 521, 520, 519, 518, 517, 516, 206/515, 513, 512, 511, 510, 509, 508, 206/507, 505, 504, 503, 501, 499, 497, 206/493, 488, 486, 485, 478, 461, 459.5, 206/459.1, 454, 453, 452, 451, 45.26, 206/45.24, 449, 448, 446, 445, 443, 427, 206/425, 423, 422, 421, 416, 414, 413, 206/410, 409, 408, 407, 404, 397, 394, 206/392, 391, 389, 386, 372, 341, 340, 206/335, 326, 322, 321, 320, 319, 318, 206/317, 304.2, 304, 303, 298, 279, 242, 206/223, 216, 206, 205, 203, 1.7, 0.6; 108/901, 53.1; 220/DIG. 6, DIG. 25, 220/DIG. 12, 918, 902, 9.4, 9.3, 9.2, 9.1, 220/890, 86.1, 847, 832, 826, 819, 817, 220/812, 811, 810, 806, 8, 797, 796, 783, 220/737, 7, 694, 693, 692, 691, 690, 686, 220/685, 684, 683, 682, 681, 679, 678, 220/677, 676, 675, 674, 673, 671, 670, 220/669, 668, 666, 661, 660, 659, 656, 220/653, 651, 650, 646, 645, 644, 643, 220/642, 641, 640, 639, 636, 635, 632, 220/630, 629, 628, 625, 622, 621, 62.2, 220/62.15, 62.11, 62, 617, 615, 612, 611, 220/610, 609, 608, 606, 605, 604, 601, 220/600, 6, 592.27, 592.26, 592.25, 220/592.2, 592.01, 592, 579, 571, 567, 220/565, 560.15, 559, 553, 552, 544, 535, 220/533, 532, 531, 530, 529, 528, 527, 220/519, 516, 507, 504, 503, 501, 500, 220/495.11, 495.06, 495.05, 495.03, 220/495.01, 495, 494, 493, 491, 489, 486, 220/485, 475, 4.34, 4.33, 4.32, 4.31, 4.29, 220/4.28, 4.27, 4.26, 4.24, 4.21, 4.17, 220/4.16, 4.13, 4.12, 4.09, 4.08, 4.05, 220/4.04, 4.03, 4.01, 380, 378, 345.2, 220/345.1, 326, 324, 323, 320, 315, 304, 220/284, 265, 245, 244, 241, 232, 23.91, 220/23.9, 23.89, 23.88, 23.87, 23.86, 220/23.83, 23.8, 23.6, 23.4, 212, 200, 1.6, 220/1.5; 414/802; 446/73, 128, 127, 446/125, 124

See application file for complete search history.

(56) References Cited

U.S. PATENT DOCUMENTS

| | | | | |
|---|---|---|---|---|
| 4,939,979 | A * | 7/1990 | Capawana | F41A 9/79 89/34 |
| 5,289,933 | A | 3/1994 | Streich | |
| 6,209,725 | B1 * | 4/2001 | Chen | B65D 25/02 206/508 |
| 6,857,535 | B1 | 2/2005 | Zuckerman | |
| 7,546,794 | B1 * | 6/2009 | Sarles | F41A 9/79 89/34 |
| 7,780,026 | B1 | 8/2010 | Zuckerman | |
| 8,316,310 | B2 | 11/2012 | Champion et al. | |
| 9,169,040 | B2 * | 10/2015 | Evans | B65D 19/18 |
| 2005/0036847 | A1 | 2/2005 | Brackmann et al. | |
| 2006/0254946 | A1 * | 11/2006 | Becklin | B65D 21/0223 206/508 |
| 2007/0215015 | A1 | 9/2007 | Heinrichs et al. | |
| 2014/0360897 | A1 | 12/2014 | Adams | |

OTHER PUBLICATIONS

International Search Report and Written Opinion mailed Mar. 19, 2020 in Application No. PCT/US20/014100.

* cited by examiner

FIG. 3
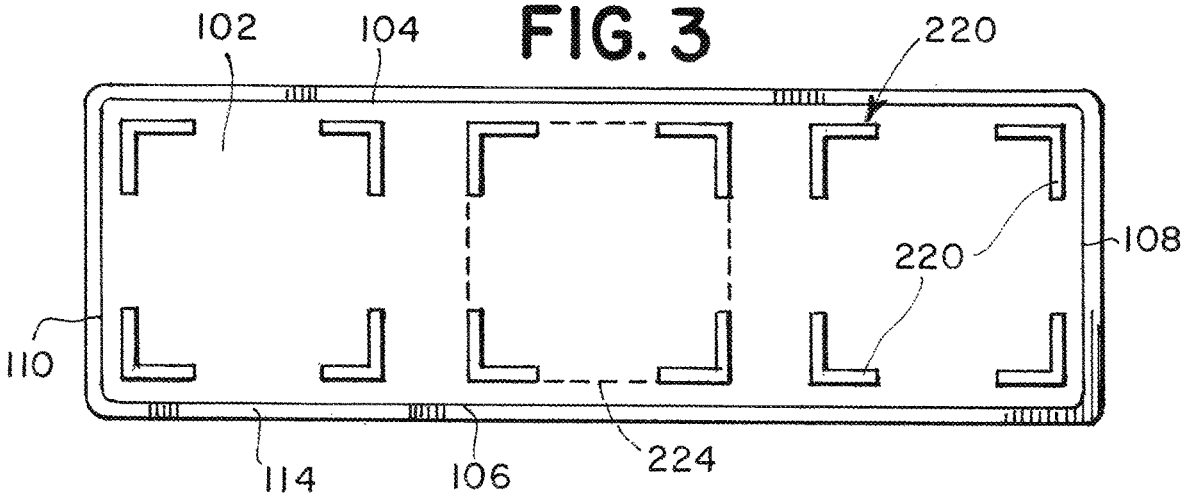
FIG. 4
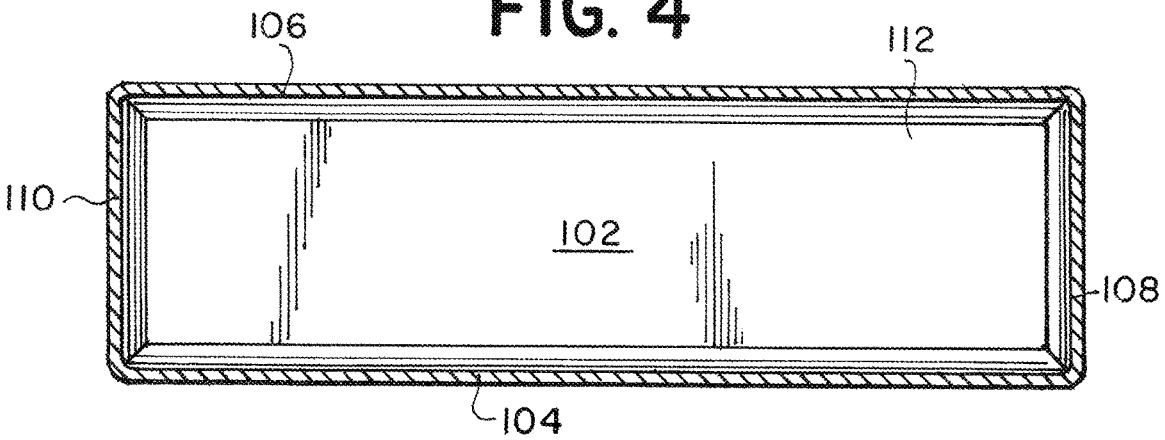
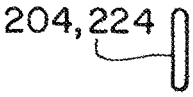
FIG. 5A
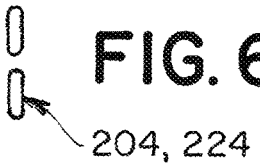
FIG. 6A
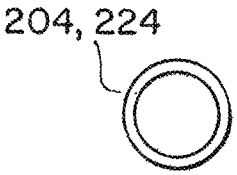
FIG. 5B
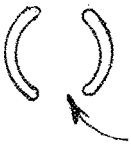
FIG. 6B
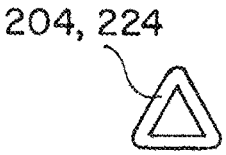
FIG. 5C
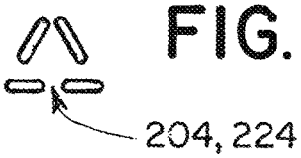
FIG. 6C
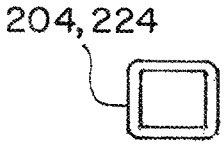
FIG. 5D
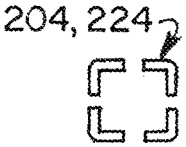
FIG. 6D FIG. 7A
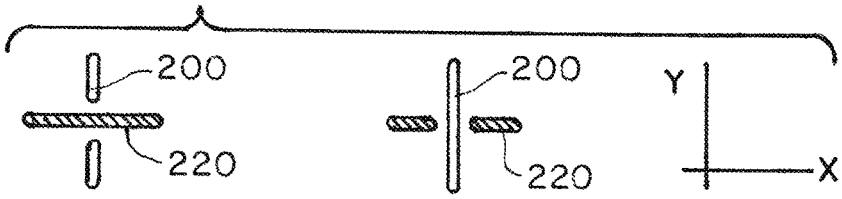
FIG. 7B
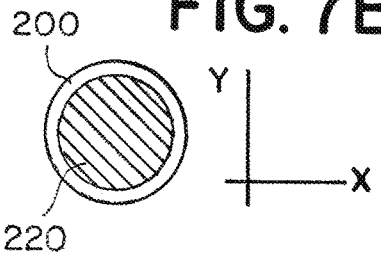
FIG. 7D
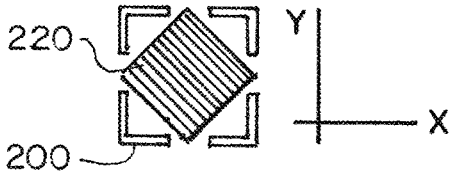
FIG. 7C
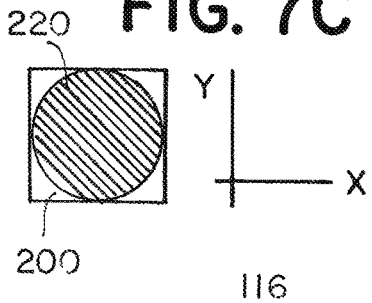
FIG. 7E
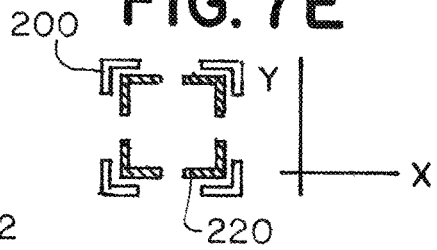
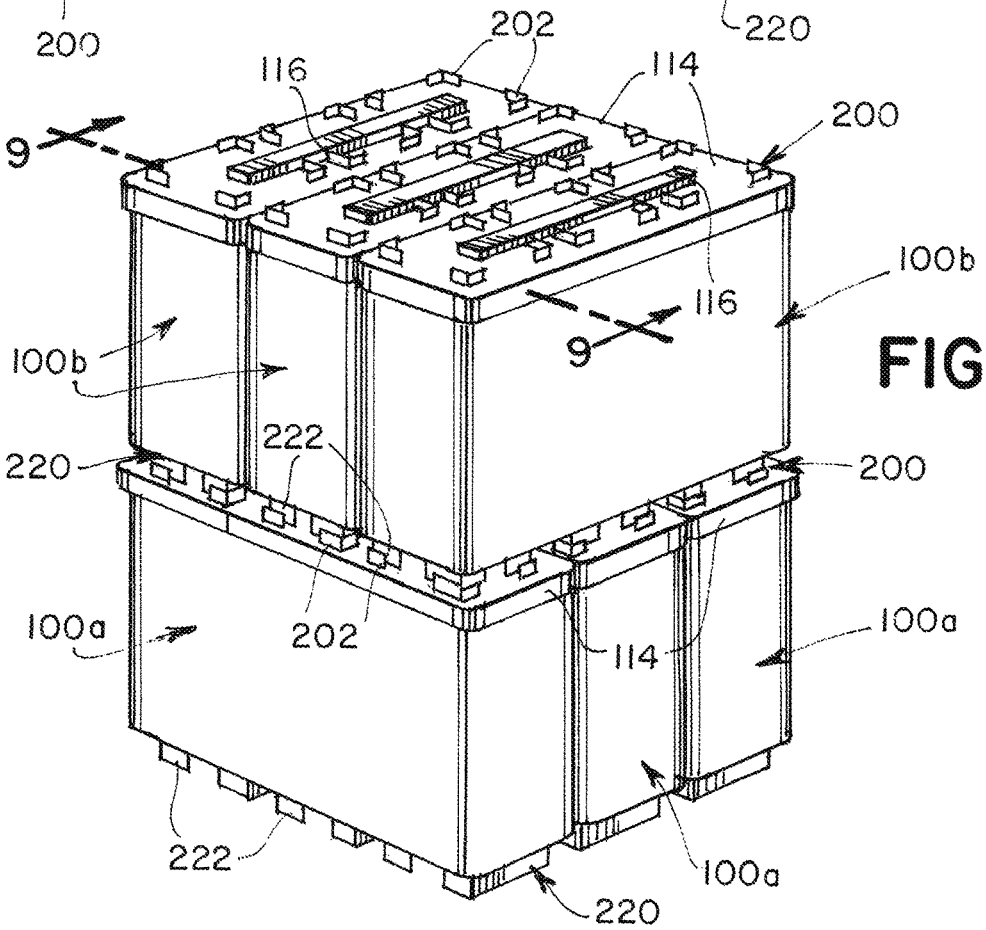
FIG. 8

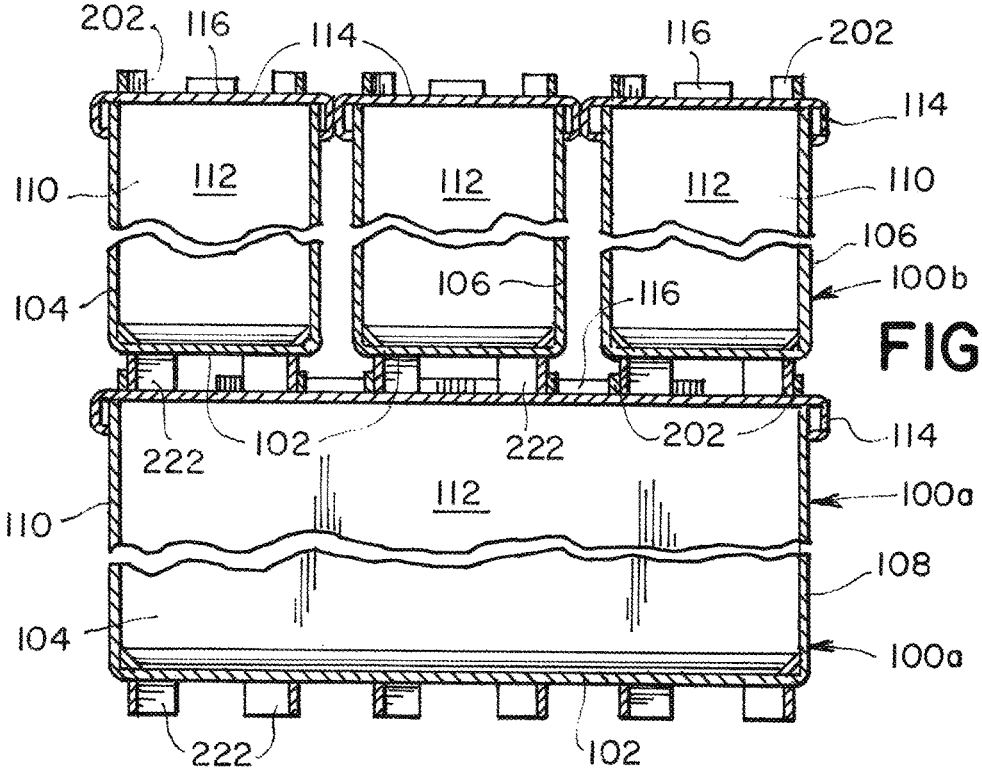
FIG. 9
FIG. 10
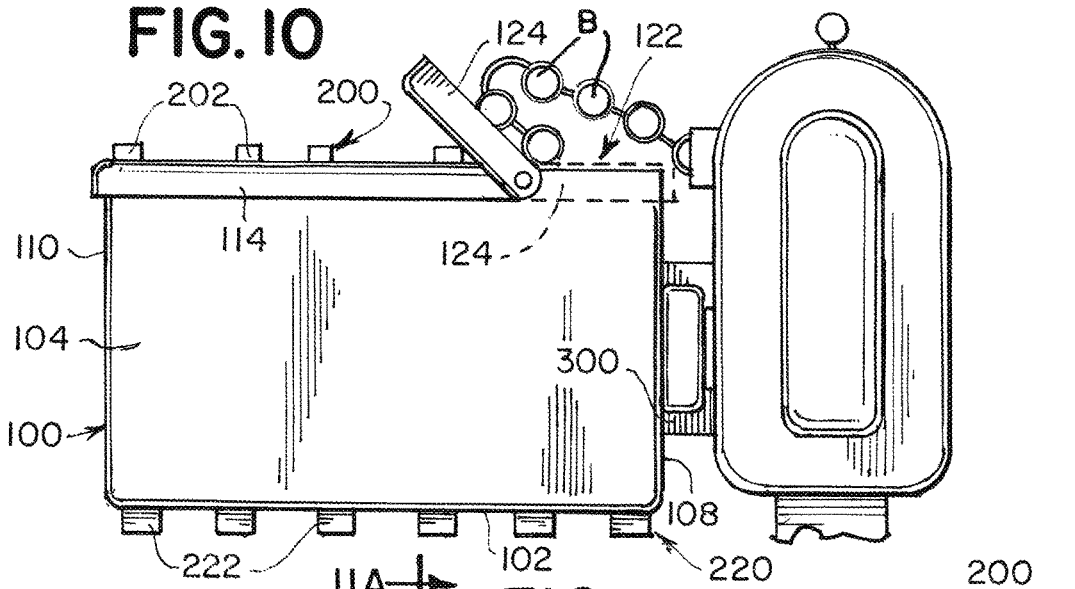
FIG. 11
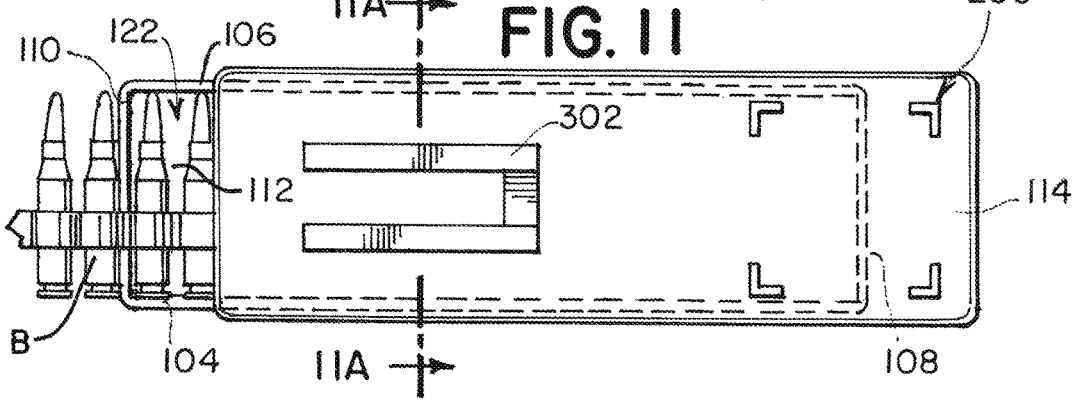

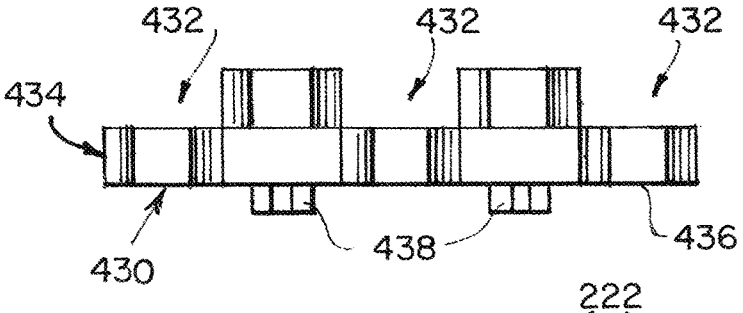
FIG. 17B
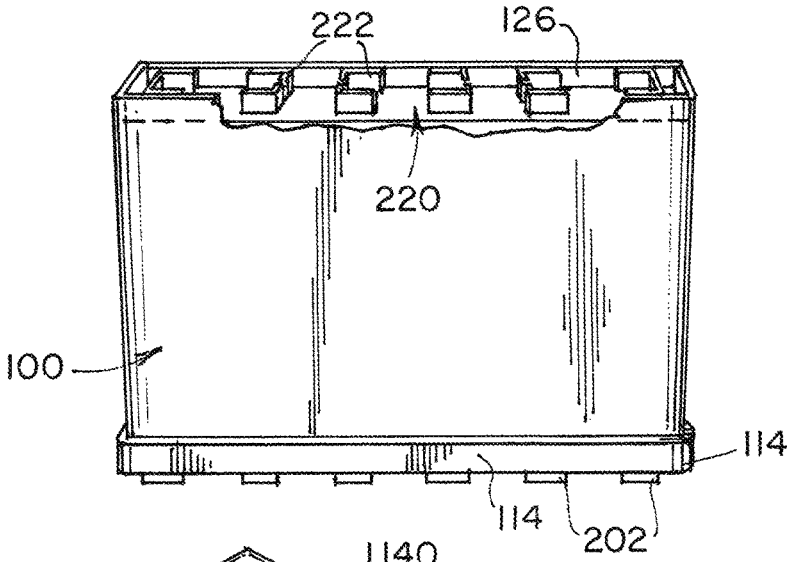
FIG. 18
FIG. 19
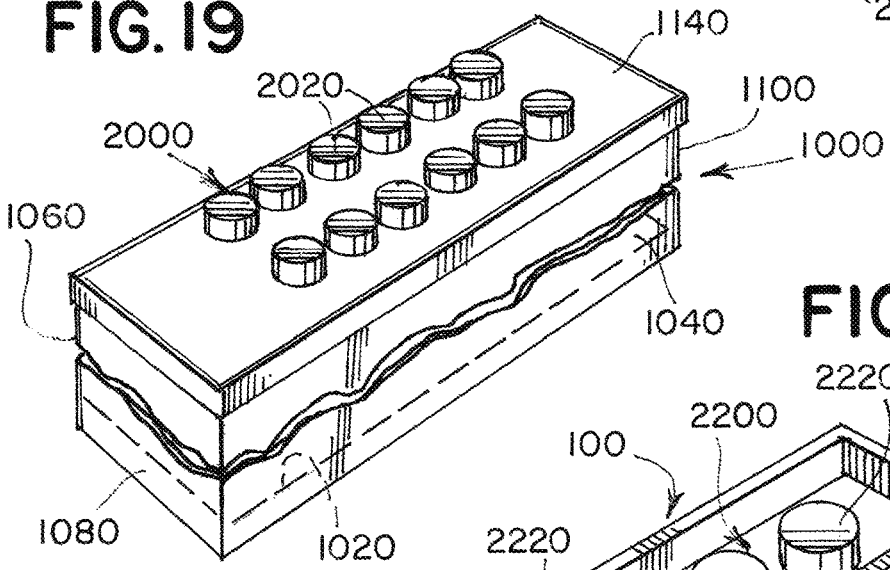
FIG. 20
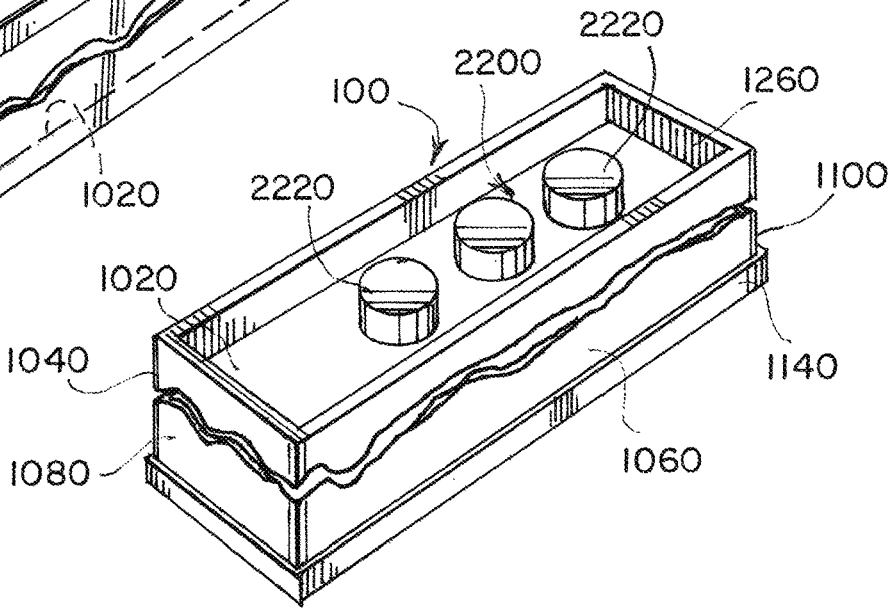

INTERLOCKING STACKING AMMUNITION CONTAINERS

CROSS REFERENCE TO RELATED APPLICATION

This application is a U.S. National Phase Application under 35 U.S.C. § 371 of International Patent Application No. PCT/US20/14100 filed Jan. 17, 2020, which claims priority to U.S. Provisional Patent Application No. 62/794,331 filed on Jan. 18, 2019. The entire contents of which are hereby incorporated by reference.

FIELD OF THE INVENTION

The invention relates to portable storage containers for ammunition that interlock when stacked to provide stability.

BACKGROUND

Existing ammunition containers have significant drawbacks when being shipped in bulk. The weight of 100 rounds of linked 50 caliber ammunition in its can is approximately 35 pounds. Existing ammunition cans have smooth surfaces so must be strapped when stacked to prevent movement in at least 4 of the 6 axes of movement (up, down, left, right, front, rear). A pallet of 50 caliber ammunition cans can contain up to 240 cans, resulting in a weight of 8,400 pounds, or 4.2 tons! Once the strapping is released if any ammo can begins to shift, this can cause massive damage if the cans begin to slip.

Civilian solutions to this problem are exemplified in the AmmoBrick, which is a plastic stacking ammunition container. The AmmoBrick's interlocking structure is discussed in U.S. Pat. No. 8,316,310 and U.S. Publication No. 2014/0360897 both to Adams. Adams' storage containers have a male protrusion and a female recess in the walls of the container. The protrusion and recess lead to a nonuniform interior having a wall with an impression and an opposite wall with a bulge. Additionally, these connectors are on the sides of the containers, so the tops are stacked to the side. Here, opening a stacked container can lead to spillage, as a fully packed container can spill out if opened when stacked. Additionally, any of the cans on the perimeter of the stack have exposed lids, again leading to an increased chance of a container opening during the rigors of shipping.

Thus, what is needed is an interlocking ammunition can, that stacks upright and having a uniform interior.

SUMMARY

An ammunition container can include a bottom wall, a first side wall and an opposing second side wall, and a front wall and an opposing rear wall. An interior volume can be formed from the bottom wall, the first side wall, the second side wall, the front wall, and the rear wall. A top lid can be removably engaged to one of the first side wall, the second side wall, the front wall, and the rear wall, opposite the bottom wall. The lid encloses the interior volume. A first interlocking stacking element can have a first raised protrusion forming a first shape. It can be disposed on one of the top lid or the bottom wall. A second interlocking stacking element of second raised protrusions forming a second shape on the opposite wall. It can be sized or shaped to interlock with the first interlocking stacking element. The first and second interlocking elements can prevent movement along at least one axis or two axes (i.e. sliding or disengagement).

An example of the ammunition container can have the bottom wall, the first side wall, the second side wall, the front wall, and the rear wall substantially smooth. This can prevent issues with removing the ammunition from the container. Especially when the container is being used as a magazine. For the interlocking features, the first shape can be a closed shape and the second shape is smaller than the first shape and fits inside the first shape.

Other examples include the first raised protrusion having first protrusions forming the first shape and the second raised protrusion having second protrusions forming the second shape. The first and second raised protrusions can form at least one of a continuous shape and a discontinuous shape.

In further examples, the front wall and/or the rear wall comprise a weapon catch to engage a weapon allowing the container to be used as a magazine. Alternately or in addition to, the top lid can have the weapon catch. If on the top lid, the weapon catch can be made from first interlocking elements. As a magazine, the top lid can have a second lid to open a gap, allowing a belt contained within the container to be accessed to be fed into the weapon.

BRIEF DESCRIPTION OF THE DRAWINGS

The drawing figures depict one or more implementations in accord with the present teachings, by way of example only, not by way of limitation. In the figures, like reference numerals refer to the same or similar elements.

FIG. 3 is a bottom view of an example of an ammunition can of the present invention;

FIG. 4 is a top cross section view of an example of an ammunition can of the present invention;

FIGS. 5A-5D illustrate examples of closed first and second shapes of the first and second interlocking stacking elements;

FIGS. 6A-6D illustrate examples of open first and second shapes of the first and second interlocking stacking elements;

FIGS. 7A-7E illustrate examples the first and second interlocking stacking elements interlocked;

FIG. 8 is a perspective view of a 3×3 stack of ammunition can of the present invention;

FIG. 9 is a cross section view of a 3×3 stack of ammunition can of the present invention;

FIG. 10 is a side view of an example of the ammunition can used a magazine;

FIG. 18 illustrates a bottom view of another example of the ammunition can;

FIG. 19 illustrates a top, front, side perspective view of a further example of an ammunition can;

FIG. 20 illustrates a bottom, front, side perspective view of a further example of an ammunition can;

DETAILED DESCRIPTION

Figure 1:
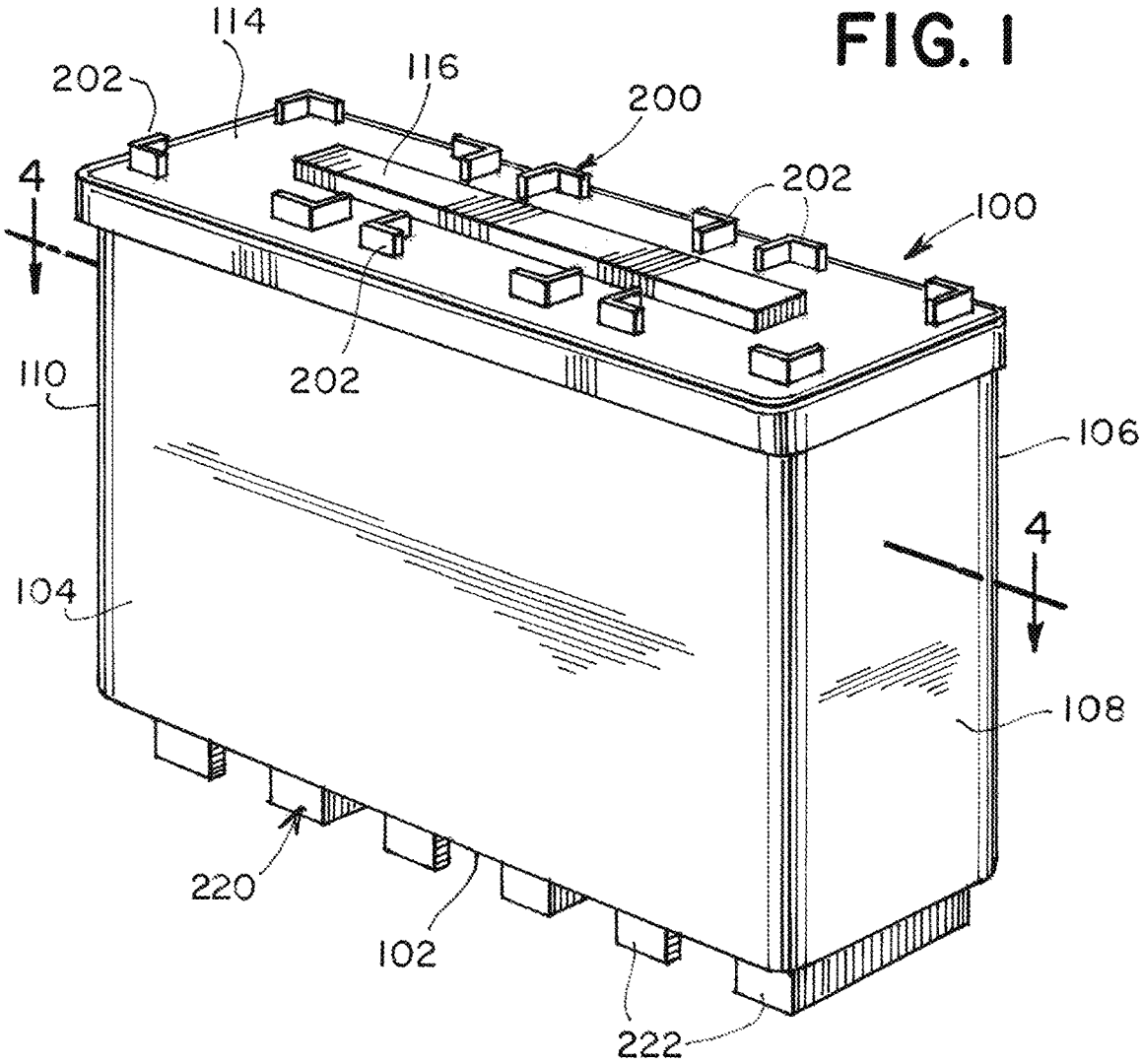
FIG. 1 is a top, front, side perspective view of an example of an ammunition can of the present invention.
Figure 2:
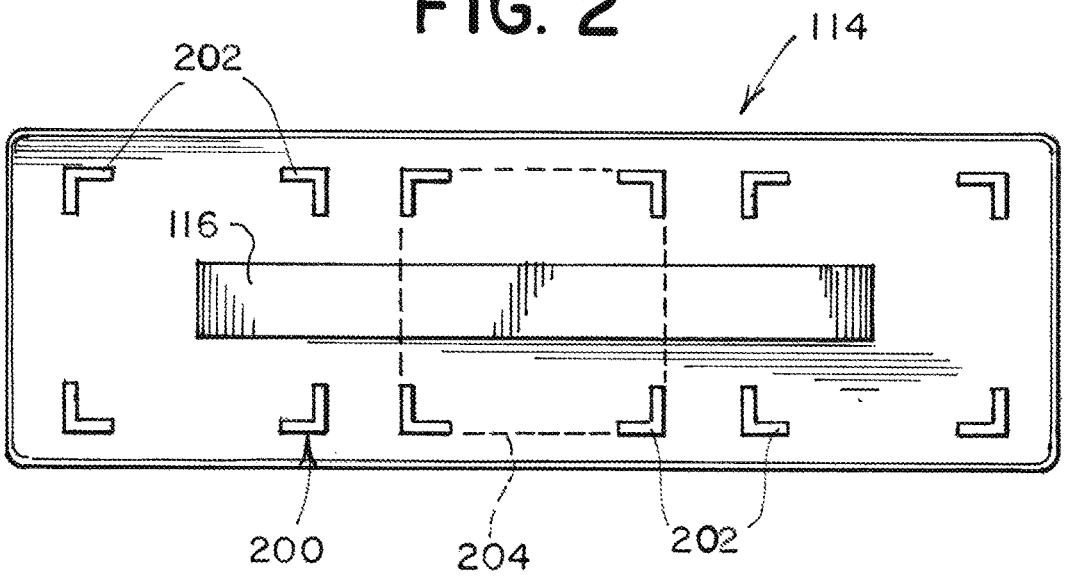
FIG. 2 is a top view of an example of an ammunition can of the present invention.

In the following detailed description, numerous specific details are set forth by way of examples in order to provide a thorough understanding of the relevant teachings. However, it should be apparent to those skilled in the art that the present teachings may be practiced without such details. In other instances, well known methods, procedures, and/or components have been described at a relatively high-level, without detail, in order to avoid unnecessarily obscuring aspects of the present teachings.

FIGS. 1-4 illustrate an ammunition container 100 having a bottom wall 102, a first side wall 104, and an opposing second side wall 106. The container also includes a front wall 108 and an opposing rear wall 110. The assembly of these walls 102, 104, 106, 108, 110 form an interior volume 112. As is known to one of skill, a container formed from the bottom wall, the first side wall, the second side wall, the front wall, and the rear wall, can take any known container shape. In examples, the opposing side walls are typically the same size, both in length and height. Similar too are the opposing front and back walls in length and height. At least the bottom wall 102, the first side wall 104, the second side wall 106, the front wall 108, and the rear wall 110 are substantially smooth in the interior volume 112, allowing for the maximum continuous storage space.

Typical shapes for ammunition containers 100 are rectangular and are sized and shaped depending on the type and number of rounds the container 100 must hold. Thus, the size and shape of a container 100 holding 7.62 mm caliber rounds can be different from a container 100 holding .50 BMG. Also, as is known in the art, the container 100 can be made from any durable material, including metals (i.e. steel or aluminum), polymer, or any alloy or combination of both (e.g. metal plated polymer). In one example, a container holding 200 rounds of 7.62 mm can be sized approximately 12 inches long, by 3 inches wide, by 10 inches high.

The sixth side to the container 100 is a top lid 114 removably engaged to at least one of the side or front/rear walls 104, 106, 108, 110. In certain examples, the lid 114 can have a handle 116 that can fold flat to the surface, other examples can be without. One example is that the top lid 114 is hinged to the rear wall 110, and engages the side walls 104, 106 when closed. The top lid 114 also typically engages with the front wall 108 to close and lock the container 100. Once closed, in certain examples, the top lid 114 can form a watertight seal to protect the contents from moisture, fluids and other foreign particles. However, in other examples, the top lid 114 can be completely unattached to any particular wall and engage with any wall, or multiple walls to allow the container 100 to close.

Further, to assist in the stacking of multiple containers 100, the container 100 has a first interlocking stacking element 200 and a second interlocking stacking element 220. The stacking elements 200, 220 can be disposed on one of the top lid 114 and the bottom wall 102, one on one, and one on the other. For the below examples, the first interlocking stacking element 200 is formed on the top lid 114 and the second interlocking stacking element 220 is formed on the bottom wall 102. The interlocking stacking elements 200, 220 can be formed from one or more raised protrusions. The first interlocking stacking element 200 can have at least one first raised protrusion 202. The first raised protrusion 202 extends away from the top lid 114 and can form a first shape 204. The first shape 204 can be any shape, from a line, to a circle, to any polygon. The second interlocking stacking element 220 can include a second raised protrusion 222 forming a second shape 224, and in this example can be disposed on the bottom wall 102.

Examples of the first and the second shapes 204, 224 are illustrated in FIGS. 5A-5D. The shapes 204, 224 can be hollow or solid and can be sized and shaped to interlock with the opposite interlocking stacking element. Once interlocked, the first and second interlocking elements 200, 220 can prevent movement along at least one axis. The examples illustrated in FIGS. 5B-5D are closed shapes, i.e. the segments forming the shape form a closed perimeter. Open shapes, illustrated in FIGS. 6A-6D, are made from a plurality of raised protrusions 202, 222 and can be formed from discontinuous segments, e.g. dashed segments, dashed-dot segment, etc. Regardless of how the shapes 204, 224 are formed, they are designed to interlock to prevent movement. In one example, the second shape 224 is smaller than the first shape 204 and fits inside the first shape 204. The closed shapes 204, 224 can be identical and one is smaller than the other. Alternately, the first shape 204 can differ from the second shape 224 but they can still interlock. For example, a circle shaped to circumscribe a square, etc. See FIGS. 7A-7E. When the plurality of raised protrusions 202, 222 forming the shape 204, 224 are discontinuous, the shapes 204, 224 can intersect or pass through each other to interlock, see FIGS. 7A and 7D.

The first and second interlocking elements 200, 220 are designed to prevent movement along at least one or two axes x, y. FIG. 7A illustrates where one set of shapes 204, 224 prevent movement in the y axis while the other set of shapes 204, 224 prevent movement in the x axis. The examples in FIGS. 7B-7E and prevent movement along both axes x, y. In one example, the interlocking elements 200, 220 only prevent two axis x, y movement and allows for movement in a third axis z. Thus, the ammunition containers 100 cannot slide relative to each other but can easily be lifted from and placed on one another. This example can be unlike child building blocks which interlock and prevent movement in three axes.

In examples, the first and second interlocking elements 200, 220 on the same ammunition can 100 do not interface, but the first interlocking element 200 on a bottom container 100*a* can interlock with the second interlocking element 220 on top container 100*b*. FIG. 8 illustrates this example and cross stacks the containers 100*a*, 100*b*. FIG. 9 also illustrates a cross-section of the containers 100*a*, 100*b*. Other examples allow the top lid 114 to be completely removed and placed under the ammunition container 100 and the interlocking elements 200, 220 of the same container can interface.

In other examples, the first and second raised protrusions 202, 222 act as feet and do not cause stability issues for the placement of the container 100 on a level surface. The protrusions 202, 222 can also act as teeth or grips on slippery surfaces. Further examples, as illustrated in FIGS. 4 and 9, the raised protrusions 202, 222 do not interfere with the internal volume 112 and are just formed on the outer walls 102, 114.

Additional considerations to the internal volume 112 are that in certain examples the walls 102, 104, 106, 108, 110 are smooth or uninterrupted, forming an interruption free interior. This is critical as belt fed ammunition can be carried in the container 100 and fed directly from the container 100 into a weapon. Interruptions, indentations, uneven walls, etc. on the interior surface can create snag points so the belt fed ammunition does not feed smoothly, which can cause jams, misloading or misfires with the weapon.

Further, the container 100 can also be designed to interface with the weapon to act as a magazine. FIG. 10 illustrates a container 100 with its lid 114 and a second lid 124. One of the front 108 or rear 110 walls can have a weapon catch 300 that interfaces with a mate on the weapon W. In this example, the weapon catch 300 is designed to interface with the side (typically left) of the weapon to allow the ammo belt B to be fed into the chamber. In one example, the weapon catch 300 can also be part of the lid locking system, used to keep the lid 114 on.

Figure 11A:
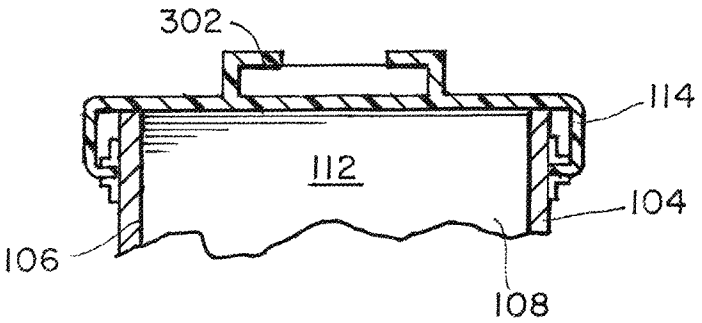
FIG. 11 is a top, partial section view of another example of the ammunition can used a magazine.
Figure 12:
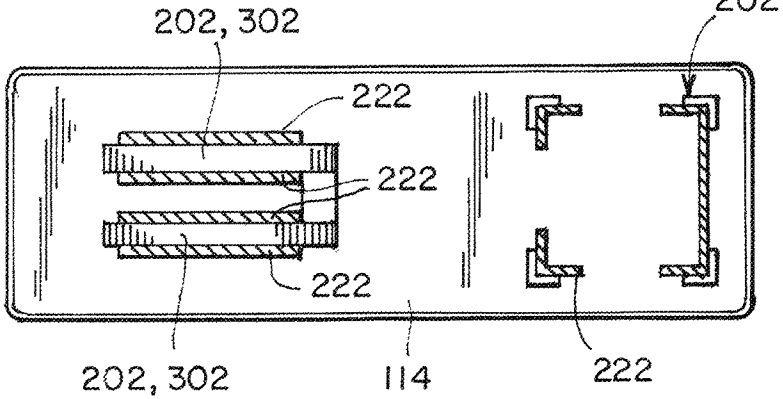
FIG. 12 is a few of the top lid and an example of a weapon catch comprising first raised protrusions and interfacing with second raised protrusions.

FIG. 11 illustrates another example where one of the first interlocking stacking elements 200 are designed to also be a weapon catch 302. FIG. 12 illustrates the weapon catch 302 also being made up of first raised protrusions 202. Here, the top lid 114 has the weapon catch 302 to slide or snap under the weapon, likely approximate to the feed port, and the belt B is fed up to the port to load the weapon. In this example, the lid 114 interfaces with the weapon W. The lid 114 can engage the container 100 by moving a first position 118 (as illustrated in FIG. 1) in which the container 100 is completely closed. In the first position 118, the lid can be locked and held in place to facilitate transport and prevent the ammunition from spilling out.

In FIG. 11, the top lid 114 is in the second position 120. The second position 120 keeps the lid 114 on the container 100 but opens it a small amount to allow the belt B a restricted opening from which to exit the interior volume 112. The second position 120 can create an opening or gap 122 large enough to allow the belt B to easily be pulled from the container 100 during firing but the container 100 still remains partially closed.

Gap 122 can also be formed by a second lid 124 (see FIG. 10) this can be a small section of the top lid 114 and can be used to open a gap 122 while the top lid 114 remains engaged. While illustrated hinged, it can be formed numerous ways, sliding, punch out, or a completely different material. For example, the second lid 124 can be a plastic film or membrane that is pulled off to open the gap 122 or left intact and the belt B can be removed by opening the top lid 114.

Moving from the first 118 to second 120 position can be accomplished with a sliding or hinged lid 114. The sliding lid can slide across the container 100 to fixed positions, specifically marking the second position 120 or can be slid the entire length to either be stopped or completely removable. A hinged lid 114 can have two or more locked positions. The first position 118 can lock the container shut, where the second position 120 opens the gap, but keeps the lid 114 open to allow for the belt B to be fed.

Figure 13A:
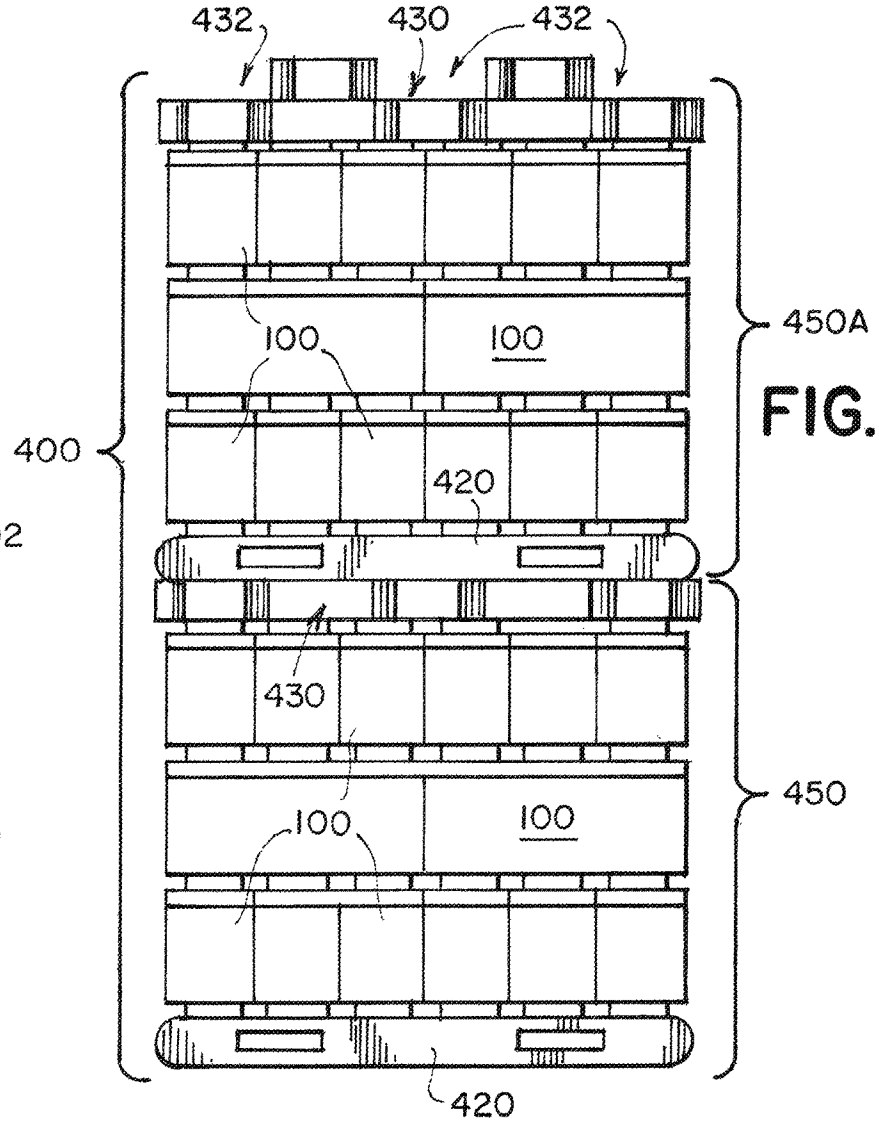
FIG. 13A is a side view of two units of ammunition containers stacked for shipping.
Figure 13B:
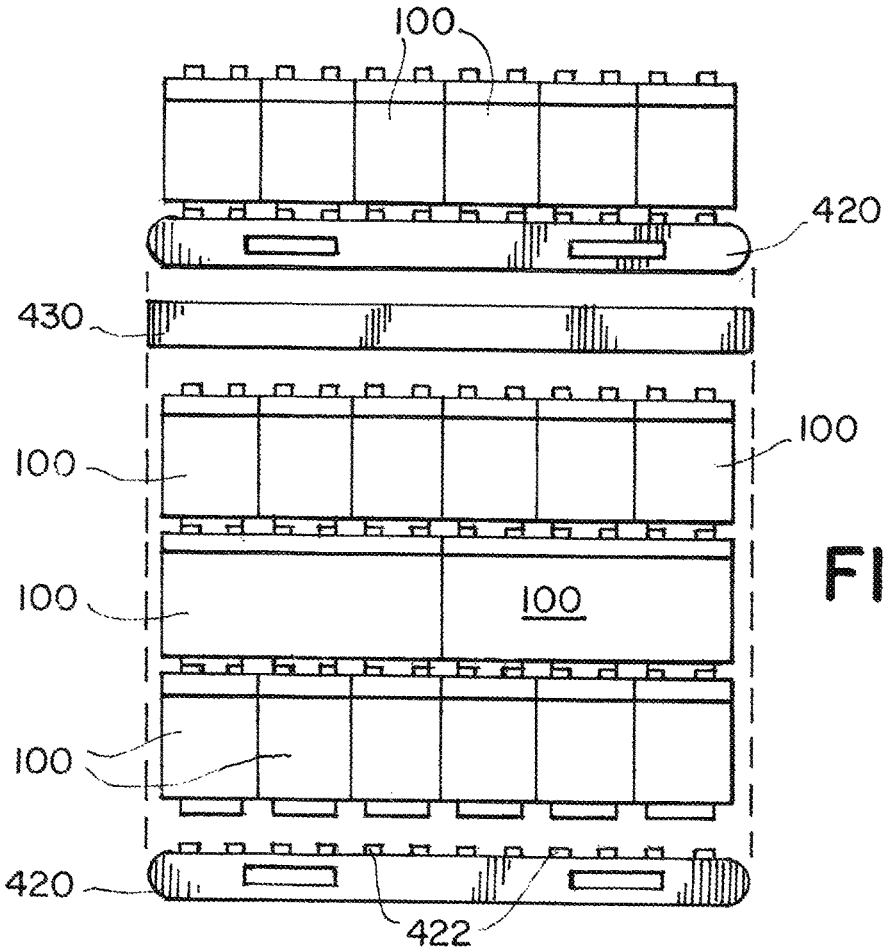
FIG. 13B is a side exploded view of one of the units.

With reference to FIGS. 13A and 13B, the following describes an overall configuration of an ammunition container transport structure 400. As shown in FIG. 13A, the ammunition container transport structure 400 is a logistics material for use in transportation and storage of ammunition containers 100. The ammunition container transport structure 400 can include a pallet 420 and a lid 430. On the pallet 420, a plurality of ammunition containers 100 can be placed with the ammunition containers 100 standing upright and aligned with a vertical direction. The lid 430 can be configured to both be interposed between the ammunition containers 100 in an upper stage and the ammunition containers 100 in a lower stage, ammunition containers 100 being stacked in multiple stages on the pallet 420. Also, the lid 430 is configured to cover the plurality of ammunition containers 100 at an uppermost stage.

Figure 14:
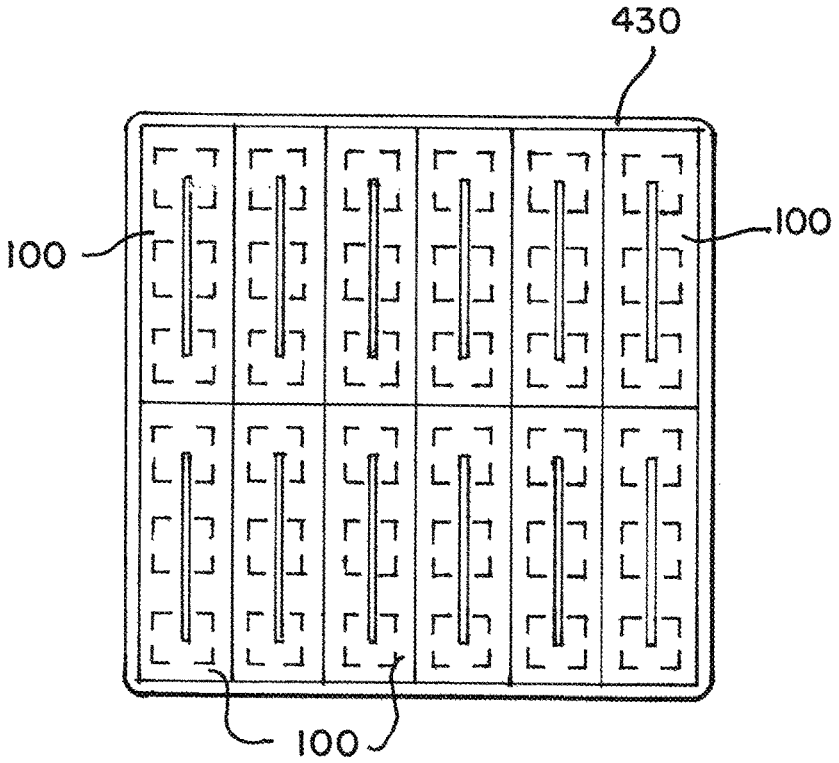
FIG. 14 is a top view of one layer of ammunition container stacked on the pallet.

According to the ammunition container transport structure 400, one unit 450 can be constituted by the pallet 420, the ammunition containers 100 stacked in multiple stages on the pallet 420 and the lid 430. Further, on the lid 430 of the one unit 450, other units 450A may be stacked in multiple stages. As an example, FIG. 13A illustrates two units 450 and 450A stacked in two stages. An illustrated group is three by three, similar to FIG. 8, and then a third set of containers 100 on top. There can be four of those groups in one stage 450 (see, FIGS. 13A and 14). Note that FIG. 13B illustrates that the ammunition container top lid 114 differs from the pallet lid 430. FIG. 13B also illustrates the modular nature of the ammunition container transport structure 400. The ammunition containers 100 can be stacked a needed based on the dimensions of the vehicle transporting the structure 400 and the weight thereof.

Figure 15:
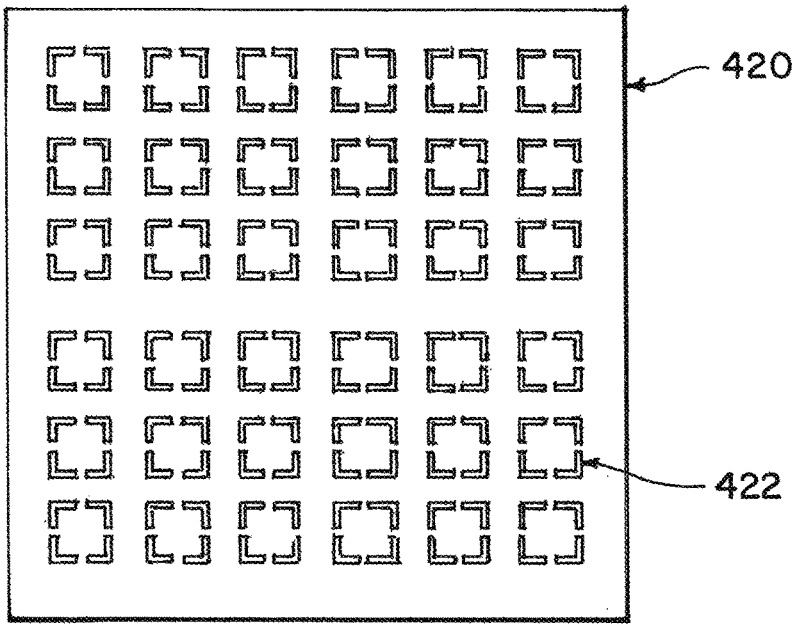
FIG. 15 is a top view of an empty pallet.

Next, with reference to FIG. 15, the pallet 420 can be made of a synthetic resin or polymer similar or identical to the polymer of the ammunition container 100. Other examples can have the pallet 420 made of any material strong enough to support the weight and shipping rigors of multiple the ammunition containers 100. The pallet 420 can be formed to have a plane having a substantially quadrangle shape, as shown in FIG. 15. The pallet 420 has an interlocking surface 422, on which a plurality of ammunition containers 100 (in this example, twelve ammunition containers 100) are to be arranged and placed. The interlocking surface 422 can be configured to mate with one or more first or second interlocking elements 200, 220 from the plurality of ammunition containers 100.

Figure 16:
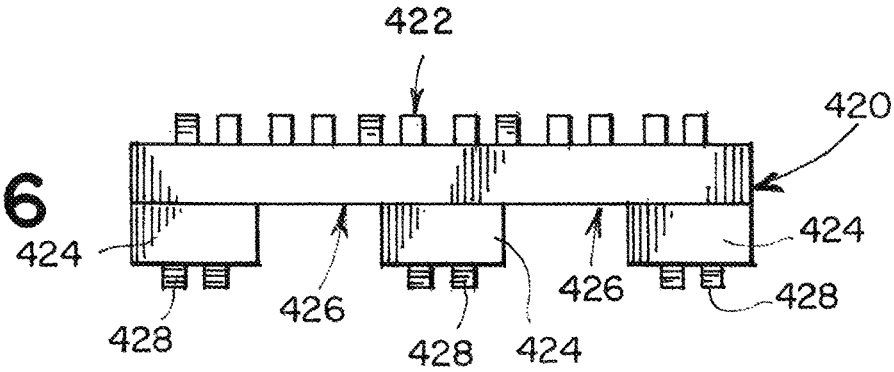
FIG. 16 is a side view of the pallet.

FIG. 16 illustrates the pallet 420 lower surface having a plurality of legs 424 projected downwardly. Each of the legs 424 extends downwardly from the interlocking surface 422. In this example, nine legs 424 are arranged at points on the lower surface of the pallet 420, which has a substantially quadrangle shape. This example shows a configuration including a fork insertion portion 426, disposed as a separation between two adjacent legs 424, into which a fork (claw) of a forklift can be inserted. Alternately, the lower surface can have a standard pallet configuration.

Figure 17A:
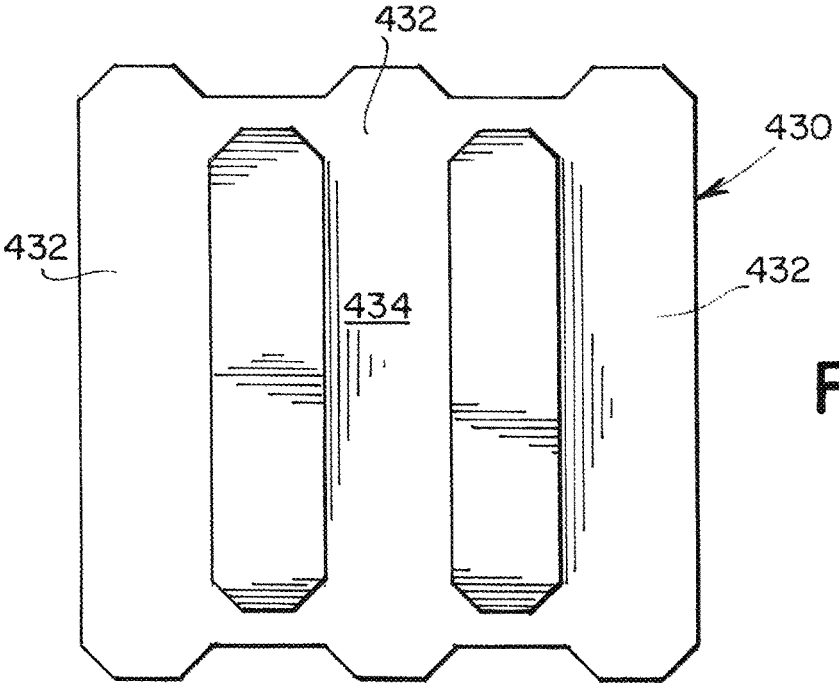
FIG. 17 is a side view of the lid.
Figure 21:
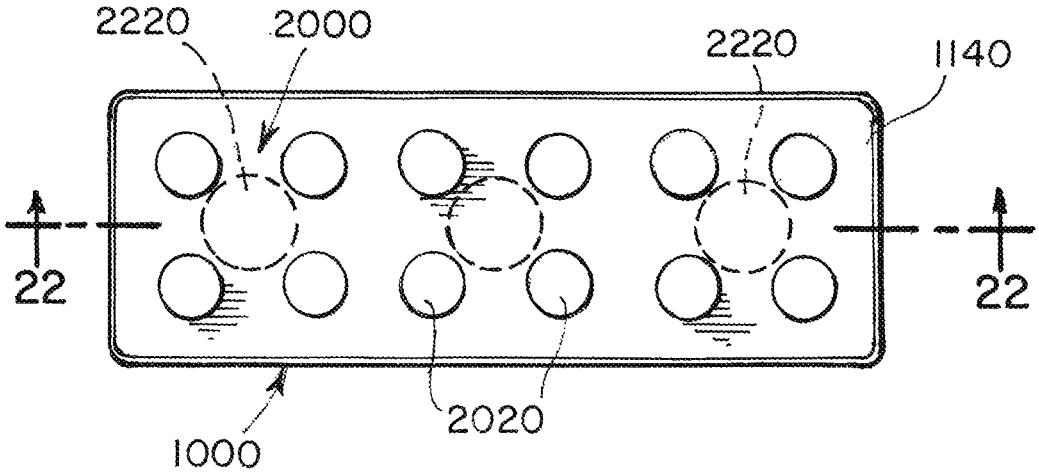
FIG. 21 illustrates the further example of the first and second interlocking stacking elements interlocked.

Next, with reference with FIG. 17, the lid 430 can be solid or a hollow resin molding integrally having a single or double-walled structure and has a plane having a substantially quadrangle shape. The lid 430 can be formed using the same materials as the pallet 420 and/or the ammunition container 100. In an example, the lid 430 can have a plurality of leg positioning recesses 432 on an upper side 434. On a lower side 436, in an example, can be one or a plurality of ammunition container positioning surfaces 438. The ammunition container positioning surfaces 438 can be configured to mate with first or second interlocking elements 200, 220 from the plurality of ammunition containers 100. Note that the leg positioning recesses 432 can have a depth such that the pallet 420 and the lid 430 maintain a distance far enough for the forks of a forklift to be inserted in the fork insertion portion 426. Other examples are that the leg positioning recesses 432 completely mate with the legs 424 and the pallet 420 and lid 430 can come into full contact.

Thus, a unit 450 can be a pallet 420 stacked with ammunition containers 100 interlocked to both the interlocking surface 422 and each other. Next a lid 430 can be placed on the top most ammunition containers 100, again the ammunition container positioning surfaces 438 can engage with first or second interlocking elements 200, 220 from the plurality of ammunition containers 100. This unit 450 can be strapped or plastic wrapped to permit shipping. A second unit 450A can be placed on top, thus the legs 424 of the second pallet 420 engage the plurality of leg positioning recesses 432 in the bottom lid 430 to keep the two units 450, 450A stable during transport.

In an alternate example, the legs 424 can have a plurality of engagement parts 428. The engagement parts 428 can be engageable with first or second interlocking elements 200, 220 from the plurality of ammunition containers 100. This example operates without a lid 430. The ammunition containers 100 are stable enough, once secured, not to need a lid 430. Thus, if two units are stacked, the plurality of engagement parts 428 engage the top most ammunition containers 100 directly. Consequently, it is possible to stack a plurality of units more stably.

Note that once emptied, the containers 100 can be used for multiple other purposes. Their interlocking features can allow the containers to be "recycled" and used for other purposes. One example, is that an empty container 100 can be filed with sand and used as a makeshift wall. Adhesive, sealant, mortar, or any other known agent can be introduced between the containers to create a permeant bond. This bond can prevent movement in all three axes.

Turning to FIG. 18, another example of an ammunition container 100 is illustrated. This example provides a skirt 126 to cover or enclose the interlocking elements 200, 220. FIG. 18 illustrates the second interlocking elements 220 on the bottom wall 102. The skirt 126 can be approximately the depth of the raised protrusions 202, 222. This can be that the skirt 126 and the raised protrusions 202, 222 are of equal depth so the ammunition container 100 sits evenly on both when on a flat surface, or the skirt 126 can be longer, allowing the ammunition container 100 to sit just on the skirt 126 or slightly shorter, allowing the ammunition container 100 to sit on the raised protrusions 202, 222. The skirt 126 can be cosmetic, just hiding all or most of the raised protrusions 202, 222 from sight.

The skirt 126, in some examples, is not considered part of the interior volume 112, still allowing the ammunition container 100 to have smooth walls 102, 104, 106, 108, 110. The skirt 126 can be sized as such to allow the interlocking elements 200, 220 to interface without interference. Even examples where both the first and second interlocking elements 200, 220 have skirts 126, they are sized as such to allow both the skirts and interlocking elements 200, 220 to interface to provide connection and stability. In some examples, the raised protrusions 202, 222 are integral to the skirt 126, other examples, the skirt 126 and the raised protrusions 202, 222 do not touch.

In forming the ammunition container 100, the skirt 126 can be considered depending from the bottom wall or from the top lid. Other examples can have the skirt 126 formed by protruding from the first side wall, the opposing second side wall, the front wall, and the opposing rear wall. However formed, in certain examples, the skirt 126 can approximately enclose at least one of the first and second interlocking elements 200, 220.

FIGS. 19-22 illustrate a further example of the ammunition can 1000 of the present invention. The ammunition container 1000 has, as above, a bottom wall 1020, a first side wall 1040, an opposing second side wall 1060, a front wall 1080 and an opposing rear wall 1100. The assembly of these walls 1020, 1040, 1060, 1080, 1100 form an interior volume 1120. As above, the walls 1020, 1040, 1060, 1080, 1100 are substantially smooth in the interior volume 1120, allowing for the maximum continuous storage space. The sixth side to the container 1000 is a top lid 1140 removably engaged to at least one of the side or front/rear walls 1040, 1060, 1080, 1100.

These examples of the first and second interlocking elements 2000, 2200 are similar to building blocks. The first interlocking element 2000 has first raised protrusions 2020, in this example, depending from the lid 1140, while the second interlocking element 2200 is recessed within the skirt 1260, and the second raised protrusions 222 is raised from the bottom wall 1020. The first and second interlocking elements 2000, 2200 on the same ammunition can 100 do not interface. Further the first interlocking elements 2000 cannot interface with first interlocking elements 2000 and the same hold true with the second interlocking elements 2200, only the first interlocking elements 2000 interface with the second interlocking elements 2200. In other examples, the first raised protrusions 2020 can act as feet if disposed from the bottom wall 1020 and do not cause stability issues for the placement of the container 1000 on a level surface.

Figure 22:
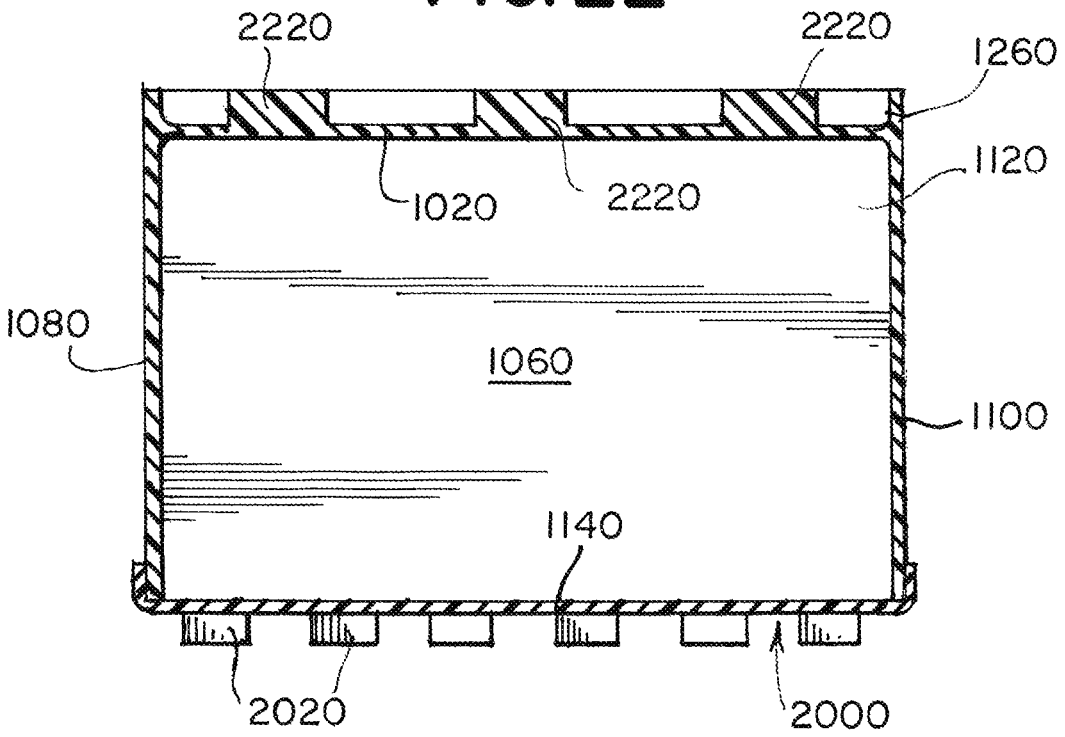
FIG. 22 illustrates a cross-section view of the further example of an ammunition can, inverted.

As illustrated in FIG. 22, the first and second interlocking elements 2000, 2200 do not interfere with the internal volume 1120 and are just formed on the outer walls 1020, 1140, and sometimes under the skirt 1260 to give the appearance of a uniform container. Note that both the pallet 420 and lid 430 can share elements to interface with any example of the ammunition container 100, 1000.

Additional considerations to the discussion of the internal volume 112, 1120 and in certain examples the walls 102, 104, 106, 108, 110, 1020, 1040, 1060, 1080, 1100 are smooth or uninterrupted, forming an interruption free interior. However, these walls 102, 104, 106, 108, 110, 1020, 1040, 1060, 1080, 1100 can have imperfections that are not smooth (i.e. roughened) but still allow for the uninterrupted access of the ammunition therein. Further, the walls 102, 104, 106, 108, 110, 1020, 1040, 1060, 1080, 1100 can be joined with rounded or chamfered corners or joints, which again do not interrupt the access of the ammunition therein in the container 100, 1000.

While the foregoing has described what are considered to be the best mode and/or other examples, it is understood that various modifications may be made therein and that the subject matter disclosed herein may be implemented in various forms and examples, and that the teachings may be applied in numerous applications, only some of which have been described herein. It is intended by the following claims to claim any and all applications, modifications and variations that fall within the true scope of the present teachings.

What is claimed is:

1. An ammunition container, comprising:

a bottom wall;

a first side wall and an opposing second side wall;

a front wall and an opposing rear wall;

an interior volume formed from the bottom wall, the first side wall, the second side wall, the front wall, and the rear wall;

a top lid removably engaging at least one of the first side wall, the second side wall, the front wall, and the rear wall, opposite the bottom wall and enclosing the interior volume;

a first interlocking stacking element comprising a first raised protrusion forming a first shape and disposed on one of the top lid and the bottom wall; and a second interlocking stacking element comprising a second raised protrusion forming a second shape and disposed on the other of the top lid and the bottom wall and is at least one of sized and shaped to interlock with the first interlocking stacking element, wherein the first raised protrusion and the second raised protrusion each form a discontinuous shape, wherein the first and second interlocking elements prevent movement along at least one axis.

2. The ammunition container of claim 1, wherein the interior volume of the bottom wall, the first side wall, the second side wall, the front wall, and the rear wall are substantially smooth.

3. The ammunition container of claim 1, wherein:

the first shape is a closed shape; and the second shape is smaller than the first shape and first inside the first shape.

4. The ammunition container of claim 1, wherein at least one of:

the first raised protrusion comprises a plurality of first protrusions forming the first shape; and the second raised protrusion comprises a plurality of second protrusions forming the second shape.

5. The ammunition container of claim 1, wherein the first and second interlocking elements prevent movement along at least two axes.

6. The ammunition container of claim 1, wherein at least one of the front wall and the rear wall comprise a weapon catch.

7. The ammunition container of claim 1, wherein the top lid comprises a weapon catch.

8. The ammunition container of claim 7, wherein the weapon catch comprises first interlocking elements.

9. The ammunition container of claim 1, wherein the top lid comprises a second lid to open a gap.

10. The ammunition container of claim 1, further comprising a skirt depending at least from one of the bottom wall, the first side wall, the opposing second side wall, the front wall, the opposing rear wall and the top lid and approximately enclosing at least one of the first and second interlocking elements.

11. An ammunition container transport structure, comprising:

a pallet comprising:

an interlocking surface configured to engage with a first interlocking stacking element disposed on an ammunition container; and a leg disposed opposite the interlocking surface and forming a fork insertion portion; and a lid comprising:

an upper side comprising a leg recess configured to accept at least a portion of the leg; and a lower side comprising an ammunition container positioning surface configured to engage a second interlocking stacking element disposed on the ammunition container, wherein the engagement configuration of the interlocking surface differs from the engagement configuration of the ammunition container positioning surface.

* * * * *